US010078281B2

(12) United States Patent
Ida et al.

(10) Patent No.: US 10,078,281 B2
(45) Date of Patent: Sep. 18, 2018

(54) TONER AND METHOD FOR PRODUCING TONER

(71) Applicant: CANON KABUSHIKI KAISHA, Tokyo (JP)

(72) Inventors: Hayato Ida, Toride (JP); Junichi Tamura, Toride (JP); Ryuji Murayama, Nagareyama (JP); Takaho Shibata, Tokyo (JP); Daisuke Yamashita, Tokyo (JP); Takashi Hirasa, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/693,662

(22) Filed: Sep. 1, 2017

(65) Prior Publication Data

US 2018/0067411 A1 Mar. 8, 2018

(30) Foreign Application Priority Data

Sep. 6, 2016 (JP) ..... 2016-173460
Aug. 4, 2017 (JP) ..... 2017-151357

(51) Int. Cl.
*G03G 9/08* (2006.01)
*G03G 9/087* (2006.01)

(52) U.S. Cl.
CPC ..... *G03G 9/08737* (2013.01); *G03G 9/0806* (2013.01); *G03G 9/08724* (2013.01)

(58) Field of Classification Search
CPC ..... G03G 9/08737; G03G 9/0806; G03G 9/08724
USPC ..... 430/109.3
See application file for complete search history.

(56) References Cited

U.S. PATENT DOCUMENTS

| | | | |
|---|---|---|---|
| 3,853,778 | A | 12/1974 | Buckley et al. |
| 5,154,998 | A | 10/1992 | Aoki et al. |
| 7,833,687 | B2 | 11/2010 | Kato et al. |
| 8,697,327 | B2 | 4/2014 | Shibata et al. |
| 9,057,970 | B2 | 6/2015 | Ida et al. |
| 9,348,247 | B2 | 5/2016 | Ida et al. |
| 9,540,483 | B2 | 1/2017 | Ida et al. |
| 9,696,644 | B2 | 7/2017 | Ida et al. |
| 2013/0108955 | A1 | 5/2013 | Shibata et al. |
| 2013/0202998 | A1 | 8/2013 | Higashi et al. |
| 2015/0099227 | A1 | 4/2015 | Ida et al. |

FOREIGN PATENT DOCUMENTS

| | | |
|---|---|---|
| JP | S56-013943 | 4/1981 |
| JP | S58-095750 | 6/1983 |
| JP | S59-018954 | 1/1984 |
| JP | S62-039428 | 8/1987 |
| JP | H03-150576 | 6/1991 |
| JP | H04-021860 | 1/1992 |
| JP | H04-120554 | 4/1992 |
| JP | H08-184986 | 7/1996 |
| JP | H11-202555 | 7/1999 |
| JP | 2011-107261 | 6/2011 |

OTHER PUBLICATIONS

U.S. Appl. No. 15/527,191, Takaho Shibata, filed May 16, 2017.
U.S. Appl. No. 15/532,543, Junichi Tamura, filed Jun. 2, 2017.
U.S. Appl. No. 15/687,726, Daisuke Yamashita, filed Aug. 28, 2017.
U.S. Appl. No. 15/730,337, Tomoyo Miyakai, filed Oct. 11, 2017.

*Primary Examiner* — Mark A Chapman
(74) *Attorney, Agent, or Firm* — Fitzpatrick, Cella, Harper and Scinto

(57) ABSTRACT

A toner having a toner particle containing a resin component, wherein the resin component contains an olefin copolymer having ester group and the like, which has a unit (1), and a unit Y2 that is at least one selected from (2) and (3), the content of the copolymer in the resin component is at least 50 mass % with respect to the total mass of the resin component, and the content of the monomer unit Y2 is 3 to 35 mass % with respect to the total mass of the copolymer;

(1)

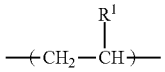

(2)

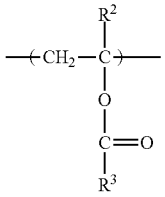

(3)

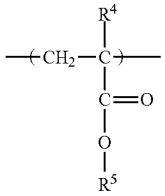

in formulas (1) to (3), $R^1$, $R^2$ and $R^4$ each independently represent H or $CH_3$, and $R^3$ and $R^5$ each independently represent $CH_3$ or $C_2H_5$.

17 Claims, No Drawings

TONER AND METHOD FOR PRODUCING TONER

BACKGROUND OF THE INVENTION

Field of the Invention

The present invention relates to toner used in electrophotographic systems and to a method for producing toner.

Description of the Related Art

In association with the increased demands of recent years for greater energy savings during image formation, efforts have been undertaken to bring about additional reductions in toner fixation temperatures. As one method for improving the low-temperature fixability of toner, Japanese Examined Patent Publication Nos. S56-13943 and S62-39428 and Japanese Patent Application Laid-open No. H04-120554 propose an art that uses a crystalline polyester resin having a sharp melt property whereby the viscosity undergoes a substantial decline when the melting point is exceeded.

In another method, Japanese Patent Application Laid-open Nos. 2011-107261, H11-202555, H08-184986, H04-21860, H03-150576, S59-18954, and S58-95750 propose lowering the fixation temperature by using a resin that has a low glass transition temperature. Toner is proposed that contains a copolymer having ethylenic ester group, such as an ethylene-vinyl acetate copolymer or an ethylene-methyl acrylate copolymer, for the resin having a low glass, transition temperature.

SUMMARY OF THE INVENTION

Due to the sharp melt property of the resin, an excellent low-temperature fixability and high-temperature storability were exhibited when conventional crystalline polyester resins were used as resins in electrophotographic toner. However, there were problems with the charge retention behavior of the toners due to the low electrical resistance of crystalline polyester resins.

To provide a resin that would have a high volume resistance and a glass transition temperature at or below room temperature, the present inventors therefore focused on copolymers having a monomer unit derived from an olefin compound such as ethylene or propylene.

Specifically, attempts were made to have the low-temperature fixability coexist with the charge retention behavior by using, for example, an ethylene(propylene)-acetate ester copolymer such as an ethylene-vinyl acetate copolymer, an ethylene(propylene)-acrylate ester copolymer such as an ethylene-methyl acrylate copolymer, or an ethylene(propylene)-methacrylate ester copolymer such as an ethylene-methyl methacrylate copolymer.

However, it has been quite difficult to provide a satisfactory low-temperature fixability under high-speed conditions by just the incorporation, in part, of these olefin copolymers having ester group in toner as proposed in Japanese Patent Application Laid-open Nos. 2011-107261, H11-202555, H08-184986, H04-21860, and H03-150576.

On the other hand, the problem of a decline in the hot offset resistance appeared when, as in Japanese Patent Application Laid-open Nos. S59-18954 and S58-95750, these olefin copolymers having ester group were used as the main resin in toner.

There has also been demand in recent years for a multimedia capacity capable of accommodating various types of recording materials (media), e.g., postcards, small size paper, envelopes, thick paper, and label paper. However, when a smaller recording material is first passed through over the fixing member during the successive passage of materials of different sizes over the fixing member, the region on the fixing member not traversed by the recording material undergoes an excessive temperature increase. When a larger recording material is then passed through over the fixing member, the toner on the larger recording material is heated to an excessive degree and the problem of hot offset is then readily produced. Thus, in the case of use of a variety of recording materials, there is also demand that the hot offset resistance be improved while maintaining the low-temperature fixability.

The present inventors pursued the co-use of commonly known high molecular weight resins in order to improve the hot offset resistance. However, the aforementioned olein copolymers having ester group have a low polarity and also have low intermolecular forces, and due to this the hot offset resistance could not be improved even with the co-use of a high molecular weight resin of an olefin copolymer having ester group.

The present invention provides a toner that has an excellent low-temperature fixability, charge retention behavior, and hot offset resistance and also provides a method for producing this toner.

As a result of intensive investigations, the present inventors found that a toner having an excellent low-temperature fixability, charge retention behavior, and hot offset resistance is obtained by the use of a crosslinked body from an aliphatic hydrocarbon resin having unsaturated bond in combination with an ethylene(propylene)-acetate ester copolymer such as an ethylene-vinyl acetate copolymer, an ethylene(propylene)-acrylate ester copolymer such as an ethylene-methyl acrylate, an ethylene(propylene)-methacrylate ester copolymer such as an ethylene-methyl methacrylate, or their mixtures.

Despite their low glass transition temperatures, these copolymers have an excellent blocking resistance at high temperatures because they have a high degree of crystallinity. However, when they are miscibilized upon the addition of another resin component, the degree of crystallinity declines and the blocking resistance then declines.

However, with the crosslinked body from the aliphatic hydrocarbon resin having unsaturated bond, due to its similar molecular structure the crystallization of the copolymer is not impaired and the blocking resistance is not reduced.

Moreover, at the fixation temperature of the toner, it rapidly miscibilizes with these copolymers and spreads in the toner, and the hot offset resistance is then substantially improved due to a molecular chain entanglement effect brought about by the crosslinked structure.

That is, the present invention is a toner having a toner particle containing a resin component, wherein the resin component contains an olefin copolymer having ester group and a crosslinked body from an aliphatic hydrocarbon resin having unsaturated bond; the olefin copolymer having ester group has a monomer unit Y1 represented by the following formula (1), and a monomer unit Y2 that is at least one selected from the group consisting of monomer units represented by the following formula (2) and monomer units represented by the following formula (3); the content of the olefin copolymer having ester group in the resin component is at least 50 mass % with respect to the total mass of the resin component; and the content of the monomer unit Y2 is at least 3 mass % and not more than 35 mass % with respect to the total mass of the olefin copolymer having ester group.

The present invention is also a method for producing a toner having a toner particle containing a resin component, the resin component containing an olefin copolymer having ester group and a crosslinked body from an aliphatic hydrocarbon resin having unsaturated bond, the method including: a preparation step of preparing a resin fine particle dispersion in which resin fine particles that form the resin component are dispersed in an aqueous medium; and crosslinking step of crosslinking, using a crosslinking agent, the aliphatic hydrocarbon resin having unsaturated bond present in the resin fine particles, wherein the olefin copolymer having ester group has a monomer unit Y1 represented by the following formula (1), and a monomer unit Y2 that is at least one selected from the group consisting of monomer units represented by the following formula (2) and monomer units represented by the following formula (3), the content of the olefin copolymer having ester group in the resin component is at least 50 mass % with respect to the total mass of the resin component, and the content of the monomer unit Y2 is at least 3 mass % and not more than 35 mass % with respect to the total mass of the olefin copolymer having ester group.

(1)

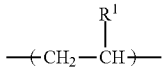

(2)

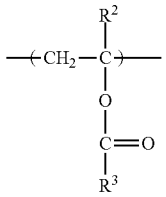

(3)

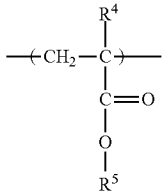

In formulas (1) to (3), $R^1$ represents H or $CH_3$, $R^2$ represents H or $CH_3$, $R^3$ represents $CH_3$ or $C_2H5$, $R^4$ represents H or $CH_3$, and $R^5$ represents $CH_3$ or $C_2H_5$.

Further features of the present invention will become apparent from the following description of exemplary embodiments.

DESCRIPTION OF THE EMBODIMENTS

Unless specifically indicated otherwise, expressions such as "at least XX and not more than YY" and "XX to YY" that show numerical value ranges refer in the present invention to numerical value ranges that include the lower limit and upper limit that are the end points.

In addition, monomer unit refers to the state of the reacted monomer substance in the polymer or resin.

A crystalline resin is a resin for which an endothermic peak is observed in differential scanning calorimetric (DSC) measurement.

The toner of the present invention is a toner having a toner particle containing a resin component, wherein the resin component contains an olefin copolymer having ester group and a crosslinked body from an aliphatic hydrocarbon resin having unsaturated bond; the olefin copolymer having ester group has a monomer unit Y1 represented by the following formula (1), and a monomer unit Y2 that is at least one selected from the group consisting of monomer units represented by the following formula (2) and monomer units represented by the following formula (3); the content of the olefin copolymer having ester group in the resin component is at least 50 mass % with respect to the total mass of the resin component; and the content of the monomer unit Y2 is at least 3 mass % and not more than 35 mass % with respect to the total mass of the olefin copolymer having ester group.

The resin component here refers to a polymer component that contributes mainly to the fixing capability.

This resin component contains an olefin copolymer having ester group and the crosslinked body from the aliphatic hydrocarbon resin having unsaturated bond.

This olefin copolymer having ester group is a polymer in which a monomer unit having ester group has been introduced into a polyolefin skeleton by a means such as copolymerization.

Specifically, it has a monomer unit Y1 given by the following formula (1) and a monomer unit Y2 that is at least one selected from the group consisting of monomer units given by the following formula (2) and monomer units given by the following formula (3).

(1)

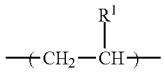

(2)

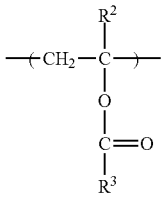

(3)

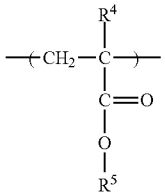

In formulas (1) to (3), $R^1$ represents H or $CH_3$, $R^2$ represents H or $CH_3$, $R^3$ represents $CH_3$ or $C_2H_5$, $R^4$ represents H or $CH_3$, and $R^5$ represents $CH_3$ or $C_2H_5$.

The olefin copolymer having ester group is specifically described in the following.

Ethylene-vinyl acetate copolymer, wherein $R^1$ in the preceding formula is H, $R^2$ is H, and $R^3$ is $CH_3$, is a specific example of this olefin copolymer having ester group.

This ethylene-vinyl acetate copolymer is preferred from the standpoint of the low-temperature fixability because a low melting point can be designed for it.

In addition, for example, ethylene-methyl acrylate copolymer, wherein $R^1$ in the preceding formula is H, $R^4$ is H, and $R^5$ is $CH_3$; ethylene-ethyl acrylate copolymer, wherein $R^1$ in the preceding formula is H, $R^4$ is H, and $R^5$ is $C_2H_5$; and ethylene-methyl methacrylate copolymer, wherein $R^1$ in the preceding formula is H, $R^4$ is $CH_3$, and $R^5$ is $CH_3$, have high chemical stabilities and are therefore preferred from the standpoint of the storage stability in high-temperature, high-humidity environments.

The resin component may contain a single olefin copolymer having ester group or a plurality thereof.

From the standpoints of the charge retention behavior and the blocking resistance, the value of (l+m+n)/W for the olefin copolymer having ester group present in the resin component is preferably at least 0.80 and more, preferably at least 0.95 and is still more preferably 1.00, where W is the total mass of the olefin copolymer having ester group, l is the mass of monomer units represented by formula (1), m is the mass of monomer units represented by formula (2), and n is the mass of monomer units represented by formula (3).

The olefin copolymer having ester group may contain a monomer unit other than the monomer unit Y1 and monomer unit Y2. There are no particular limitations here as long as the effects of the present invention are not impaired, and examples are the monomer unit represented by the following formula (4) and the vinyl monomer unit represented by formula (5).

These can be introduced through the addition of the corresponding monomer to the copolymerization reaction that produces the olefin copolymer having ester group or through modification of the olefin copolymer having ester group by a polymer reaction.

(4)

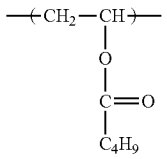

(5)

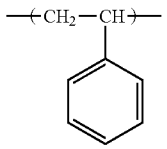

From the standpoint of the charge retention behavior, the acid value of the olefin copolymer having ester group is preferably not more than 10 mg KOH/g and more preferably not more than 5 mg KOH/g and is still more preferably substantively 0 mg KOH/g.

From the standpoint of the low-temperature fixability, the content in the resin component of the olefin copolymer having ester group is at least 50 mass % and is preferably at least 70 mass % with respect to the total mass of the resin component.

Since the glass transition temperature of the olefin copolymer having ester group is not more than 0° C., a content thereof in the resin component of at least 50 mass % provides a good low-temperature fixability.

From the standpoints of the charge retention behavior and low-temperature fixability, the content of the monomer unit Y2, with respect to the total mass of the olefin copolymer having ester group, is at least 3 mass % and not more than 35 mass % and is preferably at least 5 mass % and not more than 20 mass %.

The charge retention behavior by the toner is improved by having the content of the monomer unit Y2 be not more than 35 mass %. On the other hand, the adherence to paper is improved and a good low-temperature fixability is provided by having the content of the monomer unit Y2 be at least 3 mass %.

The masses [l], [m], and [n] of the monomer units given by the individual formulas above and the content of the monomer unit Y2 can be measured using common analytical techniques.

For example, a nuclear magnetic resonance procedure (NMR) or pyrolysis gas chromatography may be used.

A measurement method using $^1$H-NMR is considered in the following.

For example, the composition ratio for each monomer unit can be calculated by comparing each of the integral ratios for the hydrogen atoms in the monomer unit given by formula (1), the hydrogen atoms in the acetyl group in the monomer unit given by formula (2), and the hydrogen atoms in the methyl group bonded to the oxygen in the monomer unit given by formula (3).

The composition ratio for each monomer unit in an ethylene-vinyl acetate copolymer (vinyl acetate-derived monomer unit ratio: 15 mass %) is specifically calculated using the following method.

Approximately 5 mg of the sample is dissolved in 0.5 mL of deuteroacetone containing tetramethylsilane as the 0.00 ppm internal reference, and this solution is introduced into the sample tube and the $^1$H-NMR spectrum is measured under conditions of a repetition time of 2.7 seconds and a number of scans of 16.

The peak at 1.14 to 1.36 ppm corresponds to the $CH_2$—$CH_2$ in the ethylene-derived monomer unit, and the peak in the vicinity of 2.04 ppm corresponds to the $CH_3$ in the vinyl acetate-derived monomer unit. The ratio of the integration values for these peaks is calculated and the composition ratio for each monomer unit is then calculated.

The olefin copolymer having ester group preferably contains an olefin copolymer A having ester group having a softening point of at least 120° C. and not more than 160° C., and an olefin copolymer B having ester group having a softening point of at least 70° C. and not more than 100° C.

The incorporation of the olefin copolymer A having ester group having a softening point of at least 120° C. and not more than 160° C. is preferred from the standpoint of the ability to withstand the impact and pressure during toner use.

The incorporation of the olefin copolymer B having ester group having a softening point of at least 70° C. and not more than 100° C. is preferred from the standpoint of image gloss.

From the standpoint of the ability to withstand the impact and pressure during toner use, the content of the olefin copolymer A having ester group, with respect to the total mass of the resin component, is preferably at least 40 mass % and not more than 80 mass % and is more preferably at least 40 mass % and not more than 60 mass %.

From the standpoint, on the other hand, of image gloss, the content of the olefin copolymer B having ester group, with respect to the total mass of the resin component, is preferably at least 10 mass % and not more than 30 mass % and is more preferably at least 20 mass % and not more than 30 mass %.

This softening point (Tm) can be controlled by changing the molecular weight of the olefin copolymer having ester group, and the softening point can be raised by raising the molecular weight.

The softening point (Tm) is measured in the present invention using a "Flowtester CFT-500D Flow Property Evaluation Instrument" (Shimadzu Corporation), which is a constant-load extrusion-type capillary rheometer, in accordance with the manual provided with the instrument.

With this instrument, while a constant load is applied by a piston from the top of the measurement sample, the measurement sample filled in a cylinder is heated and melted and the melted measurement sample is extruded from a die at the bottom of the cylinder; a flow curve can be graphed out from the piston stroke (mm) and the temperature (° C.) during this process.

The "melting temperature by the ½ method", as described in the manual provided with the "Flowtester CFT-500D Flow Property Evaluation Instrument", is used as the softening point in the present invention.

The melting temperature by the ½ method is determined as follows.

First, ½ of the difference between the piston stroke at the completion of outflow (outflow completion point, designated Smax) and the piston stroke at the beginning of outflow (lowest point, designated Smin) is determined (this value is designated as X, where X=(Smax−Smin)/2). The temperature of the flow curve when the piston stroke in the flow curve reaches the sum of X and Smin is the melting temperature by the ½ method.

The measurement sample used is prepared by subjecting 1.2 g of the sample to compression molding for 60 seconds at 10 MPa in a 25° C. environment using a tablet compression molder (for example, the Standard Manual Newton Press NT-100H, NPa System Co., Ltd.) to provide a cylindrical shape with a diameter of 8 mm.

The specific measurement procedure follows the manual provided with the instrument.

The measurement conditions with the CFT-500D are as follows.

test mode: ramp-up method
start temperature: 60° C.
saturated temperature: 200° C.
measurement interval: 1.0° C.
ramp rate: 4.0° C./min
piston cross section area: 1.000 $cm^2$
test load (piston load): 5.0 kgf
preheating time: 300 seconds
diameter of die orifice: 1.0 mm
die length: 1.0 mm The elongation at break of the olefin copolymer having ester group is preferably at least 300% and is more preferably at least 500%. An excellent bending resistance by the fixed material is achieved by having the elongation at break be at least 300%. The upper limit on the elongation at break is equal to or less than about 1000%.

The elongation at break is measured at conditions based on JIS K 7162.

When the resin component contains a plurality of olefin copolymers having ester group, the measurement is run under these conditions after melt-mixing.

The resin component contains a crosslinked body from an aliphatic hydrocarbon resin having unsaturated bond.

The aliphatic hydrocarbon resin having unsaturated bond is an aliphatic hydrocarbon resin that has a carbon-carbon double bond or triple bond in the resin skeleton, but is not otherwise particularly limited.

Polymers of dienes having at least 4 and not more than 10 carbons, e.g., polybutadiene, polydicyclopentadiene, and 1,4-poly(1-propylbuta-1,3-diene), are preferred because they contain numerous unsaturated bond segments and the crosslinking reaction then readily advances.

Among the preceding, polybutadiene has a higher reactivity and provides a substantial improvement in the hot offset resistance of the toner.

In addition, polybutadiene has a resin skeleton resembling that of the olefin copolymer having ester group and as a consequence is not likely to impede crystallization of the olefin copolymer having ester group and a good blocking resistance is then achieved.

The weight-average molecular weight of the aliphatic hydrocarbon resin having unsaturated bond (for example, polybutadiene) is preferably at least 10,000 and not more than 300,000 and is more preferably at least 100,000 and not more than 300,000.

The blocking resistance of the toner is further improved by having the weight-average molecular weight be at least 10,000, while the reactivity in the crosslinking reaction is further increased by having the weight-average molecular weight be not more than 300,000.

The weight-average molecular weight of the aliphatic hydrocarbon resin having unsaturated bond is determined as the molecular weight as standard polystyrene using gel permeation chromatography (GPC).

The measurement instrumentation and conditions are as follows.

instrument: "GPC8020" GPC instrument, Tosoh Corporation
separation column: "TSKgelG4000HXL", Tosoh Corporation
detector: "RI-8020", Tosoh Corporation
eluent: tetrahydrofuran
eluent flow rate: 1.0 mL/min
sample concentration: 5 mg/10 mL
column temperature: 40° C.

The structures constituting the polybutadiene can be exemplified by the cis-1,4-polybutadiene structure, trans-1,4-polybutadiene structure, and 1,2-polybutadiene structure.

In addition, the 1,2-polybutadiene structure encompasses, as stereoisomers, the 1,2-atactic structure, in which the different isomers are randomly connected; the 1,2-isotactic structure, in which the same isomers are connected; and the 1,2-syndiotactic structure, in which the different isomers are connected in alternation.

In addition, the polybutadiene may also contain other monomer units on an optional basis; however, in order to exhibit crystallinity preferably it has the 1,2-polybutadiene structure and preferably a portion thereof forms the syndiotactic structure. By exhibiting crystallinity, there is then no disturbance of the crystallinity of the olefin copolymer having ester group and the storability at high temperatures is even better.

From the standpoint of the crystallinity, the content of the 1,2-polybutadiene structure in the polybutadiene is preferably at least 70 mass % and is more preferably at least 90 mass %.

In order to increase the crystallinity, preferably at least 50 mass % of the 1,2-polybutadiene structure is a syndiotactic structure.

The content of the 1,2-polybutadiene structure in the polybutadiene is preferably at least 70 mass % from the standpoint of the reactivity with the radical polymerization initiator, infra, and more preferably at least 90 mass % of the 1,2-polybutadiene structure is the syndiotactic structure.

The unsaturated bond segment in the 1,2-polybutadiene structure has a high mobility, and due to this the reactivity with the radical polymerization initiator, infra, is increased and the hot offset resistance is improved.

The mass % of the polybutadiene structure and the mass % of the structure formed by 1,2-polybutadiene can be measured using common analytical techniques; for example, techniques such as nuclear magnetic resonance (NMR) can be used.

The melting point of the aliphatic hydrocarbon resin having unsaturated bond (for example, polybutadiene) is preferably at least 60° C. and not more than 80° C. and is more preferably at least 65° C. and not more than 75° C.

The storability at high temperatures is further improved when the melting point is at least 60° C., while the gloss is further improved when the melting point is not more than 80° C.

The melting point of the polymers and so forth can be measured for the present invention using a differential scanning calorimeter (DSC).

Specifically, 0.01 to 0.02 g of the sample is exactly weighed into an aluminum pan and a DSC curve is then obtained during ramp up from 0° C. to 200° C. at a ramp rate of 10° C./min.

The melting point is taken to be the peak temperature of the maximum endothermic peak in the resulting DSC curve.

The aliphatic hydrocarbon resin having unsaturated bond is crosslinked in the present invention.

The crosslinking method can be exemplified by the use of any crosslinking agent that will react at the indicated unsaturated bond segments. A radical polymerization initiator is preferred for this crosslinking agent from the standpoint of improving the hot offset resistance.

The crosslinked bodies provided by the crosslinking of the aliphatic hydrocarbon resin having unsaturated bond are preferably dispersed in the toner particle in a finely particulate form having an average particle diameter on a volume basis of at least 10 nm and not more than 1,000 nm.

The image gloss is further improved by having the average particle diameter on a volume basis be at least 10 nm, while the hot offset resistance is further improved by having the average particle diameter on a volume basis be not more than 1,000 nm.

In order to bring about the dispersion of the crosslinked bodies in a finely particulate form in the toner, preferably the crosslinked bodies are produced in a finely particulate form having an average particle diameter on a volume basis of at least 10 nm and not more than 1,000 nm and production is then carried out by the emulsion aggregation method described below.

This particle diameter can be measured using a method such as, for example, observation using a scanning electron microscope of ruthenium-stained ultrathin sections provided by the preparation of ultrathin sections, with a thickness of about 60 nm, of the toner using a cryomicrotome.

The content of the crosslinked body from the aliphatic hydrocarbon resin having unsaturated bond, considered with respect to the total mass of the resin component, is preferably at least 1.0 mass % and not more than 8.0 mass % and is more preferably at least 1.0 mass % and not more than 3.0 mass %.

The effect on the hot offset resistance is increased by having the content of this crosslinked body be at least 1.0 mass %, while the low-temperature fixability and gloss are further increased by having the content of this cross linked body be not more than 8.0 mass %.

The resin component may additionally contain an olefin copolymer having acid group, for example, a modified polyethylene resin having carboxy group.

This modified polyethylene resin having carboxy group denotes resins provided by the random copolymerization, block copolymerization, or graft copolymerization of an additional component into a polyolefin resin that has polyethylene as its main component, and also denotes modifications of these resins through a polymer reaction.

The copolymerized component can be exemplified by acrylic acid, methacrylic acid, maleic acid, maleic anhydride, and itaconic acid.

Advantageous specific examples are ethylene-methacrylic acid copolymer and ethylene-acrylic acid copolymer.

The carboxy groups present in such a modified polyethylene resin form hydrogen bonds with the hydroxyl groups at the paper surface, thus raising the adherence between the toner and paper and preventing removal of the fixed material with, for example, an eraser.

In addition, modified polyethylene resins having carboxy group have higher melting points than olefin copolymers having ester group, and the storability at high temperatures is then improved by the incorporation of the former.

The content of the modified polyethylene resin having carboxy group, considered with respect to the total mass of the resin component, is preferably at least 10 mass % and less than 50 mass % and is more preferably at least 10 mass % and not more than 30 mass %.

When this content is in the indicated range, the adherence to paper can be improved while environmental fluctuations in the charging performance are suppressed.

Considered from the standpoints of a satisfactory adherence to paper and an improved charging performance, the acid value of the modified polyethylene resin having carboxy group is preferably at least 50 mg KOH/g and not more than 300 mg KOH/g and is more preferably at least 80 mg KOH/g and not more than 200 mg KOH/g.

This acid value is the number of milligrams of potassium hydroxide required to neutralize the acid component, such as free fatty acid and the acid in the resins, present in 1 g of a sample. The acid value is measured in accordance with JIS K 0070-1992, and in specific terms it is measured according to the following procedure.

(1) Reagent Preparation

A phenolphthalein solution is obtained by dissolving 1.0 g of phenolphthalein in 90 mL of ethyl alcohol (95 volume %) and bringing to 100 mL by adding deionized water.

7 g of special-grade potassium hydroxide is dissolved in 5 mL of water and this is brought to 1 L by the addition of ethyl alcohol (95 volume %). This is introduced into an alkali-resistant container avoiding contact with, for example, carbon dioxide, and allowed to stand for 3 days, after which time filtration is carried out to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.1 mol/L hydrochloric acid is introduced into an Erlenmeyer flask, several drops of the aforementioned phenolphthalein solution are added, and titration is performed using the potassium hydroxide solution. The 0.1 mol/L hydrochloric acid used is prepared in accordance with JIS K 8001-1998.

(2) Procedure (A) Main Test 2.0 g of the pulverized sample is exactly weighed into a 200-mL Erlenmeyer flask and 100 mL of a toluene/ethanol (2:1) mixed solution is added and dissolution is carried out over 5 hours. Several drops of the aforementioned phenolphthalein solution are then added as indicator and titration is performed using the aforementioned potassium hydroxide solution. The titration endpoint is taken to be persistence of the faint pink color of the indicator for approximately 30 seconds.

(B) Blank Test

The same titration as in the above procedure is run, but without using the sample (that is, with only the toluene/ethanol (2:1) mixed solution).

(3) The Acid Value is Calculated by Substituting the Obtained Results into the Following Formula.

$$A=[(C-B)\times f\times 5.61]/S$$

Here, A: acid value (mg KOH/g); B: amount (mL) of addition of the potassium hydroxide solution in the blank test; C: amount (mL) of addition of the potassium hydroxide solution in the main test; f: factor for the potassium hydroxide solution; and S: sample (g).

From the standpoints of the blocking resistance, the adherence between the toner and paper, and the compatibility with the olefin copolymer having ester group, the softening point of the modified polyethylene resin having carboxy group is preferably at least 100° C. and not more than 140° C.

From the standpoints of the low-temperature fixability and the storability, the melting point of the modified polyethylene resin having carboxy group is preferably at least 50° C. and not more than 100° C. and is more preferably at least 50° C. and not more than 90° C.

To the extent that the effects of the present invention are not impaired, the resin component may also contain an additional polymer other than the olefin copolymer having ester group, the crosslinked body from the aliphatic hydrocarbon resin having unsaturated bond, and the modified polyethylene resin having carboxy group.

The following are specific examples: homopolymers of styrene and its substituted forms, e.g., polystyrene, poly-p-chlorostyrene, and polyvinyltoluene; styrenic copolymers such as styrene-p-chlorostyrene copolymers, styrene-vinyltoluene copolymers, styrene-vinylnaphthalene copolymers, styrene-acrylate ester copolymers, and styrene-methacrylate ester copolymers; as well as polyvinyl chloride, phenolic resins, natural resin-modified phenolic resins, natural resin-modified maleic acid resins, acrylic resins, methacrylic resins, polyvinyl acetate, silicone resins, polyester resins, polyurethane resins, polyamide resins, furan resins, epoxy resins, xylene resins, polyethylene resins, and polypropylene resins.

The toner particle may contain an aliphatic hydrocarbon that has a melting point of at least 50° C. and not more than 100° C.

From the standpoints of the low-temperature fixability and charging performance, the content of this aliphatic hydrocarbon, with respect to 100 parts by mass of the resin component, is preferably at least 1 part by mass and not more than 40 parts by mass, more preferably at least 10 parts by mass and not more than 35 parts by mass, and still more preferably at least 10 parts by mass and not more than 30 parts by mass.

This aliphatic hydrocarbon can promote the plasticization of the olefin copolymer having ester group when heat is applied. Due to this, by incorporating an aliphatic hydrocarbon in the toner particle, the olefin copolymer having ester group, which forms the matrix in the toner particle, is plasticized and the low-temperature fixability can be further increased.

In addition, an aliphatic hydrocarbon having a melting point of at least 50° C. and not more than 100° C. can also function as a nucleating agent for the olefin copolymer having ester group. Due to this, the micromobility of the olefin copolymer having ester group is restrained and the charging performance is further enhanced.

Specific examples of this aliphatic hydrocarbon are aliphatic hydrocarbons having at least 20 and not more than 60 carbons, e.g., hexacosane, triacontane, and hexatriacontane.

The toner particle may contain a silicone oil as a release agent.

The release agents ordinarily used in toners, such as alkyl waxes, readily miscibilize with olefin copolymers having ester group, making it difficult to obtain a release effect.

In addition, when the toner particle contains a colorant, the dispersity of the colorant is enhanced by the addition of a silicone oil and a high-density image is then readily obtained.

The silicone oil can be exemplified by dimethylsilicone oil, methylphenylsilicone oil, methylhydrogensilicone oil, amino-modified silicone oil, carboxy-modified silicone oil, alkyl-modified silicone oil, and fluorine-modified silicone oil.

The viscosity of the silicone oil is preferably at least 5 $mm^2/s$ and not more than 1,000 $mm^2/s$ and is more preferably at least 20 $mm^2/s$ and not more than 1,000 $mm^2/s$.

From the standpoints of suppressing a decline in the flowability while obtaining a satisfactory releasability, the content of the silicone oil, with respect to 100 parts by mass of the resin component, is preferably at least 1 part by mass and not more than 30 parts by mass, more preferably at least 5 parts by mass and not more than 25 parts by mass, and still more preferably at least 5 parts by mass and not more than 20 parts by mass.

The toner particle may contain a colorant. This colorant can be exemplified as follows.

The black colorants can be exemplified by carbon black and magnetic bodies and by black colorants obtained by color mixing using a yellow colorant, magenta colorant, and cyan colorant to give a black color.

A pigment may be used by itself for the colorant, but the enhanced sharpness provided by the co-use of a dye with a pigment is more preferred from the standpoint of the image quality of full-color images.

Pigments for magenta toners can be exemplified by C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 0.81:1, 83, 87, 88, 89, 90, 112, 114, 122, 123, 146, 147, 150, 163, 184, 202, 206, 207, 209, 238, 269, and 282; C.I. Pigment. Violet 19; and C.I. Vat Red 1, 2, 10, 13, 15, 23, 29, and 35.

Dyes for magenta toners can be exemplified by oil-soluble dyes such as C.I. Solvent Red 1, 3, 8, 23, 24, 25, 27, 30, 49, 81, 82, 83, 84, 100, 109, and 121; C.I. Disperse Red 9; C.I. Solvent Violet 8, 13, 14, 21, and 27; and C.I. Disperse Violet 1, and basic dyes such as C.I. Basic Red 1, 2, 9, 12, 13, 14, 15, 17, 18, 22, 23, 24, 27, 29, 32, 34, 35, 36, 37, 38, 39, and 40; and C.I. Basic Violet 1, 3, 7, 10, 14, 15, 21, 25, 26, 27, and 28.

Pigments for cyan toners can be exemplified by C.I. Pigment Blue 2, 3, 15:2, 15:3, 15:4, 16, and 17; C.I. Vat Blue 6; C.I. Acid Blue 45; and copper phthalocyanine pigments having at least 1 and not more than 5 phthalimidomethyl groups substituted on the phthalocyanine skeleton.

C.I. Solvent Blue 70 is an example of a dye for cyan toners.

Pigments for yellow toners can be exemplified by C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185; and by C.I. Vat Yellow 1, 3, and 20.

C.I. Solvent Yellow 162 is an example of a dye for yellow toners.

A single one of these colorants may be used or a mixture may be used and these colorants may also be used in a solid solution state.

The colorant is selected considering the hue angle, chroma, lightness, lightfastness, OHP transparency, and dispersibility in the toner.

The colorant content is preferably at least 1 part by mass and not more than 20 parts by mass with respect to 100 parts by mass of the resin component.

From the standpoint of generating a high-definition image, the median diameter on a volume basis of the toner is preferably at least 3.0 μm and not more than 10.0 μm and is more preferably at least 4.0 μm and not more than 7.0 μm.

The median diameter on a volume basis of the toner may be measured using a particle size distribution analyzer based on the Coulter principle (Coulter Multisizer III, Beckman Coulter, Inc.).

The method for producing the toner of the present invention is a method for producing a toner having a toner particle containing a resin component, the resin component containing an olefin copolymer having ester group and a crosslinked body from an aliphatic hydrocarbon resin having unsaturated bond, the method including: a preparation step of preparing a resin fine particle dispersion in which resin fine particles that form the resin component are dispersed in an aqueous medium; and a crosslinking step of crosslinking, using a crosslinking agent, the aliphatic hydrocarbon resin having unsaturated bond present in the resin fine particles, wherein the olefin copolymer having ester group has a monomer unit Y1 represented by the preceding formula (1) and a monomer unit Y2 that is at least one selected from the group consisting of monomer units represented by the preceding formula (2) and monomer units represented by the preceding formula (3), the content of the olefin copolymer having ester group in the resin component is at least 50 mass % with respect to the total mass of the resin component, and the content of the monomer unit Y2 is at least 3 mass % and not more than 35 mass % with respect to the total mass of the olefin copolymer having ester group.

The method for producing a toner having the indicated toner particle includes a preparation step of preparing a resin fine particle dispersion in which resin fine particles that form the resin component are dispersed in an aqueous medium, and a crosslinking step of crosslinking, using a crosslinking agent, the aliphatic hydrocarbon resin having unsaturated bond present in the resin fine particles.

Resin fine particles in which, a crosslinked body is finely dispersed can be prepared by carrying out the crosslinking of the aliphatic hydrocarbon resin having unsaturated bond in a resin fine particle dispersion where dispersion is effected in an aqueous medium. As a result, the low-temperature fixability is excellent and the hot offset resistance can be improved.

The use of the emulsion aggregation method is preferred from among methods for producing toner particles in an aqueous medium. This emulsion aggregation method is a toner particle production method in which a dispersion of resin fine particles sufficiently smaller than the target particle diameter is prepared in advance and the resin fine particles are then aggregated in an aqueous medium.

That is, fine particles are formed, wherein the fine particles are sufficiently smaller than the toner particle and contain the aliphatic hydrocarbon resin having unsaturated bond, and crosslinked bodies that are more finely dispersed can then be formed in the toner particle during the production process by effecting crosslinking using a crosslinking agent. The low-temperature fixability and hot offset resistance are further improved as a result.

The following are preferably additionally present in the emulsion aggregation method after the preparation step of preparing a resin fine particle dispersion: an aggregation step of aggregating the resin fine particles to form an aggregated particle; and a fusion step of fusing the aggregated particle by heating.

In addition, the crosslinking step preferably is a step of crosslinking, using the crosslinking agent, the aliphatic hydrocarbon resin having unsaturated bond present in the resin fine particles, the crosslinking step being provided between the preparation step of preparing a resin fine particle dispersion and the aggregation step.

In addition to the steps indicated in the preceding, for example, a cooling step, a washing step, and a drying step may also be implemented.

A toner production method using an emulsion aggregation procedure is specifically described in the following, but this does not imply a limitation thereto or thereby.

<Preparation Step of Preparing Resin Fine Particle Dispersion>

The resin fine particle dispersion can be prepared by known methods, but the following method is an advantageous example.

For example, two fine particle dispersions may be prepared: a resin fine particle A dispersion in which resin fine particles A are dispersed in an aqueous medium, wherein the resin fine particle A contains an olefin copolymer having ester group and does not contain an aliphatic hydrocarbon resin having unsaturated bond; and a resin fine particle B dispersion in which resin fine particles B are dispersed in an aqueous medium, wherein the resin fine particle B contains an aliphatic hydrocarbon resin having unsaturated bond.

The use of these two resin fine particle dispersions makes it possible to bring about substantial improvements in the hot offset resistance and gloss by enabling control of the state of dispersion in the toner particle of the crosslinked body from the aliphatic hydrocarbon resin having unsaturated bond as described below.

The resin fine particle A dispersion may be prepared, for example, as follows.

A uniform solution is formed by dissolving only the olefin copolymer having ester group in an organic solvent. This is followed by the addition of a basic compound and optionally a surfactant. Fine particles are formed by the addition of an aqueous medium to this solution. Finally, the organic solvent is removed to prepare a resin fine particle A dispersion in which resin fine particles A are dispersed.

The resin fine particle B dispersion, on the other hand, may be prepared, for example, as follows.

A uniform solution is formed by dissolving at least the aliphatic hydrocarbon resin having unsaturated bond in an organic solvent. This is followed by the addition of a basic compound and optionally a surfactant. Fine particles are formed by the addition of an aqueous medium to this solution. Finally, the organic solvent is removed to prepare a resin fine particle B dispersion in which resin fine particles B are dispersed.

In addition, the resin fine particle B dispersion may also be a dispersion in which a resin fine particle B containing an olefin copolymer having ester group and an aliphatic hydrocarbon resin having unsaturated bond, is dispersed in an aqueous medium.

In this case, the resin fine particle B may be formed by a co-emulsification procedure in which the olefin copolymer having ester group and aliphatic hydrocarbon resin having unsaturated bond are dissolved together.

When a co-emulsification procedure is used, the olefin copolymer having ester group and the aliphatic hydrocarbon resin having unsaturated bond in the microparticulated organic phase are uniformly intermingled in the fine particle and the miscibility between the two in the toner particle is further improved and the hot offset resistance is further improved.

More specifically, the olefin copolymer having ester group and aliphatic hydrocarbon resin having unsaturated bond are dissolved in the organic solvent with heating and a surfactant and/or a basic compound is added. Then, co-emulsion having a resin (the resin fine particle B dispersion) is produced by gradually adding an aqueous medium while applying shear force using, for example, a homogenizer.

Alternatively, the co-emulsion having resin may be produced by the application, after the addition of the aqueous medium, of shear force using, for example, a homogenizer. This is followed by removal of the organic solvent by heating or pressure reduction to produce the resin fine particle B dispersion.

The content of the aliphatic hydrocarbon resin having unsaturated bond in the resin fine particle B is preferably at least 5 mass % and not more than 20 mass % with respect to the total amount of the resin constituting the resin fine particle B. By having this be at least 5 mass %, the reactivity of the aliphatic hydrocarbon resin having unsaturated bond in the resin fine particle is increased and the crosslinking step then proceeds smoothly. On the other hand, by having this be not more than 20 mass %, the excessive development of the reaction in the crosslinking step can be prevented and the hot offset resistance of the toner is further improved.

When the aforementioned modified polyethylene resin having carboxy group is incorporated in the resin fine particle, this may be dissolved in the organic solvent together with the olefin copolymer having ester group and/or aliphatic hydrocarbon resin having unsaturated bond.

By having the resin fine particle contain this modified polyethylene resin having carboxy group, the reactivity of the fine particles in the emulsion aggregation method is increased and an excellent particle diameter distribution is achieved for the resulting toner particles.

In the preparation of the resin fine particle dispersion, the amount of addition of the resin component that is dissolved in the organic solvent, with respect to 100 parts by mass of the organic solvent, is preferably at least 10 parts by mass and not more than 50 parts by mass and is more preferably at least 30 parts by mass and not more than 50 parts by mass.

Any organic solvent capable of dissolving the resins can be used as the organic solvent, but solvents having a high capacity to dissolve the olefin copolymer having ester group, e.g., toluene, xylene, and ethyl acetate are preferred.

There are no particular limitations on the surfactant. Examples here are anionic surfactants such as sulfate ester salts, sulfonate salts, carboxylate salts, phosphate esters, and soaps; cationic surfactants such as amine salts and quaternary ammonium salts; and nonionic surfactants such as polyethylene glycols, ethylene oxide adducts on alkylphenols, and polyhydric alcohol types.

The basic compound can be exemplified by inorganic bases such as sodium hydroxide and potassium hydroxide, and organic bases such as triethylamine, trimethylamine, dimethylaminoethanol, and diethylaminoethanol. A single basic compound may be used by itself or two or more may be used in combination.

The median diameter on a volume basis of the resin fine particles is preferably at least 50 nm and not more than 1,000 nm and is more preferably at least 100 nm and not more than 600 nm. A toner particle having a desirable particle diameter is readily obtained when the median diameter is in the indicated range.

In particular, the median diameter on a volume basis of the resin fine particle B is preferably at least 50 nm and not more than 1,000 nm and is more preferably at least 100 nm and not more than 600 nm. By having the median diameter be in the indicated range, the dispersed diameter of the crosslinked fine particles in the toner particle then becomes at least 50 nm and not more than 1,000 nm, which is preferred from the standpoint of the coexistence of the hot offset resistance with the gloss.

This median diameter on a volume basis is measured using a dynamic light-scattering particle size distribution analyzer (Nanotrac UPA-EX150, Nikkiso Co., Ltd.).

<Crosslinking Step>

The crosslinking step is a step of crosslinking, using a crosslinking agent, the aliphatic hydrocarbon resin having unsaturated bond present in the resin fine particles.

This crosslinking step preferably is a step of crosslinking, using a crosslinking agent, the aliphatic hydrocarbon resin having unsaturated bond present in the resin fine particles, the crosslinking step being provided between the preparation step of preparing a resin fine particle dispersion and the aggregation step, vide infra.

In addition, the crosslinking step is preferably provided after the completion of the preparation step of preparing a resin fine particle dispersion and prior to the start of the aggregation step.

By executing the crosslinking step in the indicated interval, sufficiently small crosslinked fine particles having a uniform particle diameter can be formed and the low-temperature fixability and hot offset resistance are then further improved.

More specifically, the crosslinking reaction may be run by adding the crosslinking agent and heating while stirring the resin fine particle B dispersion containing the aliphatic hydrocarbon resin having unsaturated bond.

The crosslinking agent is preferably a radical polymerization initiator.

This radical polymerization initiator may be oil soluble or water soluble, and either type of initiator may be used; however, water-soluble radical polymerization initiators are preferred from the standpoint of the uniformity of the reaction.

The radical polymerization initiators are exemplified by the following compounds:

azobisnitriles such as 2,2'-azobis(2-methylpropionitrile), 2,2'-azobis(2-methylbutyronitrile), 2,2'-azobisisobutyronitrile, 2,2'-azobis(2,4-dimethylvaleronitrile), 2,2'-azobis(2,4-dimethyl-4-methoxyvaleronitrile), 1,1'-azobis(cyclohexanecarbonitrile), and 2,2'-azobis(2-amidinopropane) hydrochloride; diacyl peroxides such as acetyl peroxide, octanoyl peroxide, 3,5,5-trimethylhexanoyl peroxide, decanoyl peroxide, lauroyl peroxide, and benzoyl peroxide; dialkyl peroxides such as di-t-butyl peroxide, t-butyl-a-cumyl peroxide, and dicumyl peroxide; peroxy esters such as t-butyl peroxyacetate, α-cumyl peroxypivalate, t-butyl peroxyoctoate, t-butyl peroxyneodecanoate, t-butyl peroxylaurate, t-butyl peroxybenzoate, di-t-butyl peroxyphthalate, and di-t-butyl peroxyisophthalate; hydroperoxides such as t-butyl hydroperoxide, 2,5-dimethylhexane-2, 5-dihydroperoxide, cumene hydroperoxide, and diisopropylbenzene hydroperoxide; peroxycarbonates such as t-butyl peroxyisopropyl carbonate; inorganic peroxides such as hydrogen peroxide; and persulfate salts such as potassium persulfate, sodium persulfate, and ammonium persulfate.

The amount of addition of the crosslinking agent (particularly a radical polymerization initiator) is preferably at least 0.1 parts by mass and not more than 20 parts by mass with respect to 100 parts by mass of the aliphatic hydrocarbon resin having unsaturated bond.

The crosslinking reaction will proceed satisfactorily when the amount of crosslinking agent addition is in the indicated range.

The crosslinking agent may be added as such as a solid or may be added dissolved in water.

The heating temperature is, for example, preferably at least 10° C. and not more than 40° C. higher than the 10-hour half-life temperature of the radical polymerization initiator. In addition, the heating time is preferably at least 1 hour and not more than 12 hours. The crosslinking reaction will proceed satisfactorily and crosslinked structures can be obtained when the heating temperature and heating time are in the indicated ranges. From the standpoint of the hot offset resistance, the crosslinked body provided by the crosslinking of the aliphatic hydrocarbon resin having unsaturated bond is preferably crosslinked to a degree whereby the crosslinked body does not dissolve in hot toluene (for example, toluene heated to about 90° C.)

<Aggregation Step>

The aggregation step is, for example, a step in which a mixture is prepared by mixing a colorant fine particle dispersion, an aliphatic hydrocarbon fine particle dispersion, and a silicone oil emulsion into the aforementioned resin fine particle A dispersion and resin fine particle B dispersion, and then aggregating the fine particles present in the prepared mixture to form aggregated particles. An advantageous example of the method for forming the aggregated particles is to add and mix an aggregating agent into the aforementioned mixture and raise the temperature and/or apply, for example, mechanical force, as appropriate.

The colorant fine particle dispersion is prepared by dispersing a colorant, see above. The colorant fine particles can be dispersed using a known method, but, for example, the use is preferred of a rotating shear-type homogenizer; a media-based disperser such as a ball mill, sand mill, or attritor; or a high-pressure counter-collision disperser. In addition, a polymeric dispersing agent and/or a surfactant that imparts dispersion stability can be added on an optional basis.

The aliphatic hydrocarbon fine particle dispersion and silicone oil emulsion are produced by dispersing the corresponding material in an aqueous medium. The corresponding material is dispersed using a known method, but, for example, the use is preferred of a rotating shear-type homogenizer; a media-based disperser such as a ball mill, sand mill, or attritor; or a high-pressure counter-collision disperser. In addition, a polymeric dispersing agent and/or a surfactant that imparts dispersion stability can be added on an optional basis.

The aggregating agent is, for example, the metal salt of a monovalent metal such as sodium and potassium; the metal salt of a divalent metal such as calcium and magnesium; the metal salt of a trivalent metal such as iron and aluminum; and polyvalent metal salts such as polyaluminum chloride. From the standpoint of the particle diameter controllability in the aggregation step, the metal salt of a divalent metal, e.g., calcium chloride and magnesium sulfate is preferred.

The addition and mixing of the aggregating agent is preferably carried out in the temperature range from room temperature to 75° C. Aggregation proceeds in a stable manner when this mixing is carried out under the indicated temperature condition. This mixing can be carried out using a known mixing apparatus, a homogenizer, a mixer, and so forth.

The median diameter on a volume basis of the aggregated particles formed in the aggregation step is not particularly limited, but generally should be controlled to about at least 4.0 μm and not more than 7.0 μm so as to assume about the same median diameter as the toner particle to be obtained. This control can be readily exercised by suitably setting and varying the stirring and mixing conditions as well as the temperature conditions during the addition of, for example, the aggregating agent, and during mixing.

The median diameter on a volume basis of the aggregated particles is measured using a particle size distribution analyzer based on the Coulter principle (Coulter Multisizer III, Beckman Coulter, Inc.).

<Fusion Step>

The fusion step is a step of heating the aggregated particle to at least the melting point of the olefin copolymer having ester group to effect fusion in the aggregated particle and thereby produce a particle by smoothing the surface of the aggregated particle.

Prior to introduction into the primary fusion step, a chelating agent, pH modifier, surfactant, and so forth may be introduced as appropriate in order to prevent melt-adhesion between the obtained resin particles.

The chelating agent can be exemplified by ethylenediaminetetraacetic acid (EDTA) and its alkali metal salts such as the Na salt, sodium gluconate, sodium tartrate, potassium citrate and sodium citrate, nitrilotriacetate (NTA) salts, and numerous water-soluble polymers (polymer electrolytes) containing both the COOH and OH functionalities.

The heating temperature here should be between at least the melting point of the olefin copolymer having ester group present in the aggregated particle and the temperature at which the olefin copolymer having ester group or modified polyethylene resin having carboxy group (also referred to below as an olefin copolymer having acid group) undergoes thermal decomposition. With regard to the time for the heating and fusion, shorter times are sufficient at higher heating temperatures, while longer times are required at lower heating temperatures. That is, the heating and fusion time, because it is dependent on the heating temperature, cannot be unconditionally specified, but is generally about 10 minutes to 10 hours.

<Cooling Step>

The cooling step is a step of cooling the temperature of the aqueous dispersion having resin particle yielded by the fusion step to a temperature lower than the crystallization temperature of the olefin copolymer having ester group.

The production of coarse particles can be prevented by carrying out cooling to a temperature lower than this crystallization temperature. In addition, the cooling rate is approximately 0.1 to 50° C./min.

Moreover, a crystallization-promoting annealing is preferably carried out during or after cooling by holding at a temperature at which the olefin copolymer having ester group has a fast crystallization rate. Crystallization is promoted by holding at a temperature of 30° C. to 70° C., and as a result the blocking resistance of the toner is further improved.

<Washing Step>

The impurities in the resin particles produced by carrying out the preceding steps can be removed by repeatedly washing and filtering the resin particles.

Specifically, preferably the resin particles are washed using an aqueous solution containing a chelating agent, e.g., ethylenediaminetetraacetic acid (EDTA) and its Na salt, and are additionally washed with pure water.

Through repeated filtration a plurality of times, washing with pure water can remove, e.g., the metal salts and surfactant present in the resin particles. The number of filtrations is preferably 3 to 20 from a production efficiency standpoint, while 3 to 10 is more preferred.

<Drying Step>

Toner particles may be obtained by drying the washed resin particles.

These toner particles may be used as such as a toner. In addition, the toner may also optionally be provided by the addition, with the application of shear force in a dry condition, of inorganic fine particles, e.g., of silica, alumina, titania, and calcium carbonate, and/or resin fine particles, e.g., of vinyl resin, polyester resin, and silicone resin. These inorganic fine particles and resin fine particles function as external additives, e.g., flowability auxiliary agent and cleaning auxiliary agent.

EXAMPLES

The present invention is described below in greater detail using examples and comparative examples, but the modes of the present invention are not limited to or by these. Unless specifically indicated otherwise, the % and number of parts in the examples and comparative examples are on a mass basis in all instances.

<Resin Fine Particle A1 Dispersion Production Example>

| | |
|---|---|
| toluene (Wako Pure Chemical Industries, Ltd.) | 300 parts |
| ethylene-vinyl acetate copolymer [EVA-A] ($R^1$ = H, $R^2$ = H, $R^3$ = $CH_3$, content of monomer unit Y2: 15 mass %, acid value: 0 mg KOH/g, weight-average molecular weight (Mw): 110,000, softening point (Tm): 128° C., melting point: 86° C., elongation at break: 700%, (l + m + n)/W = 1.00) | 100 parts |
| olefin copolymer having acid group A [EMA-A] (ethylene-methacrylic acid copolymer, softening point (Tm): 123° C., melting point: 90° C., acid value: 90 mg KOH/g) | 25 parts |

This formulation was mixed and dissolution was carried out at 90° C.

Separately, 0.7 parts of sodium dodecylbenzenesulfonate, 1.5 parts of sodium laurate, and 1.65 parts of N,N-dimethylaminoethanol were added to 700 parts of deionized water and dissolution was carried out with heating at 90° C.

The aforementioned toluene solution and aqueous solution were then mixed and were stirred at 7,000 rpm using a T.K. Robomix (PRIMIX Corporation) ultrahigh-speed stirrer.

Emulsification was performed at a pressure of 200 MPa using a Nanomizer high-pressure impact-type disperser (Yoshida Kikai Co., Ltd.).

This was followed by removal of the toluene using an evaporator and concentration adjustment with deionized water to obtain an aqueous dispersion of resin fine particle A1 at a concentration of 20% (resin fine particle A1 dispersion).

The median diameter on a volume basis of resin fine particle A1, measured using a dynamic light-scattering particle size distribution analyzer (Nanotrac, Nikkiso Co., Ltd.), was 0.40 μm.

<Resin Fine Particle A2 Dispersion Production Example>

A resin fine particle A2 dispersion was obtained by proceeding as in the Resin Fine Particle A1 Dispersion Production Example, but changing the 100 parts of [EVA-A] to 50 parts of [EVA-A] and 50 parts of an ethylene-vinyl acetate copolymer [EVA-B] ($R^1$=H, $R^2$=H, $R^3$=$CH_3$, content of monomer unit Y2: 15 mass %, acid value: 0 mg KOH/g, softening point (Tm): 83° C., melting point: 77° C., (l+m+n)/W=1.00). The median diameter on a volume basis of the resulting resin fine particle A2 was 0.33 μm. The elongation at break for a mixture of [EVA-A] and [EVA-B] in equal amounts was 450%.

<Resin Fine Particle A3 Dispersion Production Example>

A resin fine particle A3 dispersion was obtained by proceeding as in the Resin Fine Particle A2 Dispersion Production Example, but in this case without using the olefin copolymer having acid group A [EMA-A] and the N,N-dimethylaminoethanol. The median diameter on a volume basis of the resulting resin fine particle A3 was 1.23 μm.

<Resin Fine Particle A4 Dispersion Production Example>

A resin fine particle A4 dispersion was obtained by proceeding as in the Resin Fine Particle A1 Dispersion Production Example, but changing the [EVA-A] to an ethylene-ethyl acrylate copolymer [EEA-A] ($R^1$=H, $R^4$=H, $R^5$=$C_2H5$, content of monomer unit Y2: 15 mass %, acid value: 0 mg KOH/g, softening point (Tm): 125° C., melting point: 87° C., elongation at break: 800%, (l+m+n)/W=1.00). The median diameter on a volume basis of the resulting resin fine particle A4 was 0.54 μm.

<Resin Fine Particle A5 Dispersion Production Example>

A resin fine particle A5 dispersion was obtained by proceeding as in the Resin Fine Particle A1 Dispersion Production Example, but changing the 100 parts of [EVA-A] to 80 parts of [EVA-A] and 20 parts of a polyester resin A [PES-A] [composition (molar ratio) [polyoxypropylene (2.2)-2,2-bis(4-hydroxyphenyl)propane:isophthalic acid:terephthalic acid=100:50:50], number-average molecular weight (Mn): 4,600, weight-average molecular weight (Mw): 16,500, peak molecular weight (Mp): 10,400, softening point (Tm): 120° C., glass transition temperature (Tg): 70° C., acid value: 13 mg KOH/g]. The median diameter on a volume basis of the resulting resin fine particle A5 was 0.33 μm.

<Resin Fine Particle A6 Dispersion Production Example>

A resin fine particle A6 dispersion was obtained by proceeding as in the Resin Fine Particle A1 Dispersion Production Example, but changing the [EVA-A] to an ethylene-vinyl acetate-vinyl valerate copolymer [EVA-C]=H, $R^2$=H, $R^3$=$CH_3$, content of monomer unit Y2: 15 mass %, content of monomer unit [formula (4)] derived from vinyl valerate: 4 mass %, acid value: 0 mg KOH/g, weight-average molecular weight (Mw): 120,000, softening point (Tm): 130° C., melting point: 75° C., elongation at break: 600%, (l+m+n)/W=0.96). The median diameter on a volume basis of the resulting resin fine particle A6 Was 0.44 μm.

<Resin Fine Particle A7 Dispersion Production Example>

A resin fine particle A7 dispersion was obtained proceeding as in the Resin Fine Particle A1 Dispersion Production Example, but changing the [EVA-A] to an ethylene-vinyl acetate-vinyl valerate copolymer [EVA-D] ($R^1$=H, $R^2$=H, $R^3$=$CH_3$, content of monomer unit Y2: 5 mass %, content of monomer unit [formula (4)] derived from vinyl valerate: 25 mass %, acid value: 0 mg KOH/g weight-average molecular weight (Mw): 110,000, softening point (Tm): 118° C., melting point: 71° C., elongation at break: 550%, (l+m+n)/W=0.75). The median diameter on a volume basis of the resulting resin fine particle A7 was 0.42 μm.

<Resin Fine Particle A8 Dispersion Production Example>

A resin fine particle A8 dispersion was obtained by proceeding as in the Resin Fine Particle A1 Dispersion Production Example, but changing the [EVA-A] to an ethylene-vinyl acetate copolymer [EVA-E] ($R^1$=H, $R^2$=H, $R^3$=$CH_3$, content of monomer unit Y2: 2 mass %, acid value: 0 mg KOH/g, melting point: 105° C., softening point (Tm): 156° C., elongation at break: 600%, (l+m+n)/W=1.00). The median diameter on a volume basis of the resulting resin fine particle A8 was 0.51 μm.

<Resin Fine Particle A9 Dispersion Production Example>

A resin fine particle, A9 dispersion was obtained by proceeding as in the Resin Fine Particle A1 Dispersion Production Example, but changing the [EVA-A] to an ethylene-vinyl acetate copolymer [EVA-F] ($R^1$=H, $R^2$=H, $R^3$=$CH_3$, content of monomer unit Y2: 41 mass %, acid value: 0 mg KOH/g, softening point (Tm): 160° C., melting point: 40° C., elongation at break: 870%, (l+m+n)/W=1.00). The median diameter on a volume basis of the resulting resin fine particle A9 was 0.51 μm.

<Resin Fine Particle A10 Dispersion Production Example>

A resin fine particle A10 dispersion was obtained by proceeding as in the Resin Fine Particle A1 Dispersion Production Example, but without using the [EVA-A] and without using the [EMA-A] and changing the use amount of the polyester resin A [PES-A] [composition (molar ratio) [polyoxypropylene(2.2)-2,2-bis(4-hydroxyphenyl)propane: isophthalic acid terephthalic acid=100:50:50], number-average molecular weight (Mn): 4,600, weight-average molecular weight (Mw): 16,500, peak molecular weight (Mp): 10,400, softening point (Tm): 120° C., glass transition temperature (Tg): 70° C., acid value: 13 mg KOH/g] to 125 parts. The median diameter on a volume basis of the resulting resin fine particle A10 was 0.25 μm <Resin Fine Particle A11 Dispersion Production Example>

A resin fine particle A11 dispersion was obtained by proceeding as in the Resin Fine Particle A10 Dispersion Production Example, but changing the [PES-A] to a crystalline polyester resin A [CPES-A] [composition (molar ratio) [1,9-nonanediol:sebacic acid=100:100], number-average molecular weight (Mn): 5,500, weight-average molecular weight (Mw): 15,500, peak molecular weight (Mp): 11,400, melting point: 72° C., acid value: 13 mg KOH/g]. The median diameter on a volume basis of the resulting resin fine particle A11 was 0.25 μm.

<Crosslinked Resin Fine Particle B1 Dispersion Production Example>

| | |
|---|---|
| toluene (Wako Pure Chemical Industries, Ltd.) | 300 parts |
| ethylene-vinyl acetate copolymer [EVA-A] | 90 parts |
| aliphatic hydrocarbon resin having unsaturated bond [A1-A] [polybutadiene (content of 1,2-polybutadiene structure: 90 mass %, syndiotactic structure ratio: 50 mass %, melting point: 70° C., weight-average molecular weight (Mw): 205,000)] | 10 parts |
| olefin copolymer having acid group A [EMA-A] | 25 parts |

This formulation was mixed and dissolution was carried out at 90° C.

Separately, 0.7 parts of sodium dodecylbenzenesulfonate, 1.5 parts of sodium laurate, and 1.6 parts of N,N-dimethylaminoethanol were added to 700 parts of deionized water and dissolution was carried out with heating at 90° C.

The aforementioned toluene solution and aqueous solution were then mixed and were stirred at 7,000 rpm using a T.K. Robomix (PRIMIX Corporation) ultrahigh-speed stirrer.

Emulsification was performed at a pressure of 200 MPa using a Nanomizer high-pressure impact-type disperser (Yoshida Kikai Co., Ltd.).

This was followed by removal of the toluene using an evaporator and concentration adjustment with deionized water to obtain an aqueous dispersion of resin fine particle B1 at a concentration of 20% (resin fine particle B1 dispersion).

The median diameter on a volume basis of resin fine particle B1, measured using a dynamic light-scattering particle size distribution analyzer (Nanotrac, Nikkiso Co., Ltd.), was 0.40 μm.

Then, while stirring 500 parts of the dispersion of the resin fine particle B1, 0.5 parts of sodium persulfate was added as a radical polymerization initiator.

This was followed by heating to 90° C. and stirring for 3 hours. Cooling to room temperature then yielded a crosslinked resin fine particle B1 dispersion. The median diameter on a volume basis of the resulting crosslinked resin fine particle B1 was 0.40 μm.

<Crosslinked Resin Fine Particle B2 Dispersion Production Example>

A resin fine particle B2 dispersion and a crosslinked resin fine particle B2 dispersion were obtained by proceeding as in the Crosslinked Resin Fine Particle B1 Dispersion Production Example, but changing the 90 parts of [EVA-A] to 45 parts of [EVA-A] and 45 parts of [EVA-B]. The median diameter on a volume basis of the resulting resin fine particle B2 and crosslinked resin fine particle B2 was 0.33 μm.

<Crosslinked Resin Fine Particle B3 Dispersion Production Example>

A resin fine particle B3 dispersion and a crosslinked resin fine particle B3 dispersion were obtained by proceeding as in the Crosslinked Resin Fine Particle B2 Dispersion Production Example, but changing the [A1-A] to an aliphatic hydrocarbon resin [A1-B] having unsaturated bond [polybutadiene (content of 1,2-polybutadiene structure: 92 mass %, syndiotactic structure ratio: 55 mass %, melting point: 95° C., weight-average molecular weight (Mw): 210,000)]. The median diameter on a volume basis of the resulting resin fine particle B3 and crosslinked resin fine particle B3 was 0.42 μm.

<Crosslinked Resin Fine Particle B4 Dispersion Production Example>

A resin fine particle B4 dispersion and a crosslinked resin fine particle B4 dispersion were obtained by proceeding as in the Crosslinked Resin Fine Particle B2 Dispersion Production Example, but changing the [A1-A] to an aliphatic hydrocarbon resin [A1-C] having unsaturated bond [polybutadiene (content of 1,2-polybutadiene structure: 90 mass %, syndiotactic structure ratio: 20 mass %, melting point: none, weight-average molecular weight (Mw): 3,000)]. The median diameter on a volume basis of the resulting resin fine particle B4 and crosslinked resin fine particle B4 was 0.46 μm.

<Crosslinked Resin Fine Particle B5 Dispersion Production Example>

A resin fine particle B5 dispersion and a crosslinked resin fine particle B5 dispersion were obtained by proceeding as in the Crosslinked Resin Fine Particle B2 Dispersion Production Example, but changing the [A1-A] to an aliphatic hydrocarbon resin [A1-D] having unsaturated bond [1,4-poly(l-propylbuta-1,3-diene) (melting point: 40° C., weight-average molecular weight (Mw): 120,000)]. The median diameter on a volume basis of the resulting resin fine particle B5 and crosslinked resin fine particle B5 was 0.55 μm.

Crosslinked Resin Fine Particle B6 Dispersion Production Example

A resin fine particle B6 dispersion and a crosslinked resin fine particle B6 dispersion were obtained by proceeding as in the Crosslinked Resin Fine Particle B2 Dispersion Production Example, but without using the olefin copolymer having acid group A [EMA-A] and without using the N,N-dimethylaminoethanol and changing the use amount of the aliphatic hydrocarbon resin [A1-A] to 7.8 parts. The median diameter on a volume basis of the resulting resin fine particle B6 and crosslinked resin fine particle B6 was 1.3 μm.

<Crosslinked Resin Fine Particle B7 Dispersion Production Example>

A resin fine particle B7 dispersion and a crosslinked resin fine particle B7 dispersion were obtained by proceeding as in the Crosslinked Resin Fine Particle B1 Dispersion Production Example, but changing the [EVA-A] to the ethylene-ethyl acrylate copolymer [EEA-A]. The median diameter on a volume basis of the resulting resin fine particle B7 and crosslinked resin fine particle B7 was 0.52 μm.

<Crosslinked Resin Fine Particle B8 Dispersion Production Example>

A resin fine particle B8 dispersion and a crosslinked resin fine particle B8 dispersion were obtained by proceeding as in the Crosslinked Resin Fine Particle B1 Dispersion Production Example, but changing the 90 parts of [EVA-A] to 67.5 parts of [EVA-A] and 22.5 parts of the polyester resin A [PES-A]. The median diameter on a volume basis of the resulting resin fine particle B8 and crosslinked resin fine particle B8 was 0.52 μm.

<Crosslinked Resin Fine Particle B9 Dispersion Production Example>

A resin fine particle B9 dispersion and a crosslinked resin fine particle B9 dispersion were obtained by proceeding as in the Crosslinked Resin Fine Particle B1 Dispersion Production Example, but changing the [EVA-A] to the ethylene-vinyl acetate-vinyl valerate copolymer [EVA-C]. The median diameter on a volume basis of the resulting resin fine particle B9 and crosslinked resin fine particle B9 was 0.44 μm.

<Crosslinked Resin Fine Particle B10 Dispersion Production Example>

A resin fine particle B10 dispersion and a crosslinked resin fine particle B10 dispersion were obtained by proceeding as in the Crosslinked Resin Fine Particle B1 Dispersion Production Example, but changing the [EVA-A] to the ethylene-vinyl acetate-vinyl valerate copolymer [EVA-D]. The median diameter on a volume basis of the resulting resin fine particle B10 and crosslinked resin fine particle B10 was 0.38 μm.

<Crosslinked Resin Fine Particle B11 Dispersion Production Example>

A resin fine particle B11 dispersion and a crosslinked resin fine particle B11 dispersion were obtained by proceeding as in the Crosslinked Resin Fine Particle B1 Dispersion Production Example, but changing the use amount for the [EVA-A] to 43.75 parts and the use amount for the [A1-A] to 2.5 parts and further adding 43.75 parts of [EVA-B]. The median diameter on a volume basis of the resulting resin fine particles and crosslinked resin fine particles was 0.42 μm.

<Crosslinked Resin Fine Particle B12 Dispersion Production Example>

A resin fine particle B12 dispersion and a crosslinked resin fine particle B12 dispersion were obtained by proceeding as in the Crosslinked Resin Fine Particle B1 Dispersion Production Example, but without using the [EVA-A] and changing the use amount of the [A1-A] to 100 parts. The median diameter on a volume basis of the resulting resin fine particle B12 and crosslinked resin fine particle B12 was 0.51 μm.

<Crosslinked Resin Fine Particle B13 Dispersion Production Example>

A resin fine particle B13 dispersion and a crosslinked resin fine particle B13 dispersion were obtained by proceeding as in the Crosslinked Resin Fine Particle B6 Dispersion Production Example, but changing the [A1-A] to a polyester resin B [composition (molar ratio) [polyoxypropylene(2.2)-2,2-bis(4-hydroxyphenyl)propane:polyoxyethylene(2.2)-2,2-bis(4-hydroxyphenyl)propane:phthalic acid:terephthalic acid=15:35:35:15], number-average molecular weight (Mn): 3,000, weight-average molecular weight (Mw): 12,000, softening point (Tm): 96° C., glass transition temperature (Tg): 52° C., acid value: 10 mg KOH/g]. The median diameter on a volume basis of the resulting resin fine particle B13 and crosslinked resin fine particle B13 was 0.15 μm.

<Crosslinked Resin Fine Particle B14 Dispersion Production Example>

A resin fine particle B14 dispersion and a crosslinked resin fine particle B14 dispersion were obtained by proceeding as in the Crosslinked Resin Fine Particle B1 Dispersion Production Example, but changing the [EVA-A] to [EVA-E]. The median diameter on a volume basis of the resulting resin fine particle B14 and crosslinked resin fine particle B14 was 0.15 μm.

<Crosslinked Resin Fine Particle B15 Dispersion Production Example>

A resin fine particle B15 dispersion and a crosslinked resin fine particle B15 dispersion were obtained by proceeding as in the Crosslinked Resin Fine Particle B1 Dispersion Production Example, but changing the [EVA-A] to [EVA-F]. The median diameter on a volume basis of the resulting resin fine particle B15 and crosslinked resin fine particle B15 was 0.56 μm.

<Crosslinked Resin Fine Particle B16 Dispersion Production Example>

A resin fine particle B16 dispersion and a crosslinked resin fine particle B16 dispersion were obtained by proceeding as in the Crosslinked Resin Fine Particle B1 Dispersion Production Example, but without using the [EVA-A] and without using the [EMA-A] and using 115 parts of the polyester resin A [PES-A]. The median diameter on a volume basis of the resulting resin fine particle B16 and crosslinked resin fine particle B16 was 0.33 μm.

<Colorant Fine Particle Dispersion Production Example>

| | |
|---|---|
| colorant (cyan pigment, Dainichiseika Color & Chemicals Mfg. Co., Ltd.: Pigment Blue 15:3) | 10.0 parts |
| anionic surfactant (DKS Co. Ltd.: Neogen RK) | 1.5 parts |
| deionized water | 88.5 parts |

The preceding were mixed and dissolved and dispersion was carried out for approximately 1 hour using a Nanomizer high-pressure impact-type disperser (Yoshida Kikai Co., Ltd.) to prepare an aqueous dispersion (the colorant fine particle dispersion) containing, in a concentration of 10%, colorant fine particles provided by the dispersion of the colorant. The median diameter on a volume basis of the obtained colorant fine particles, as measured using a dynamic light-scattering particle size distribution analyzer (Nanotrac, Nikkiso Co., Ltd.), was 0.20 μm.

<Aliphatic Hydrocarbon Fine Particle Dispersion Production Example>

| | |
|---|---|
| aliphatic hydrocarbon (HNP-51, melting point = 78° C., Nippon Seiro Co., Ltd.) | 20.0 parts |
| anionic surfactant (DKS Co. Ltd.: Neogen RK) | 1.0 part |
| deionized water | 79.0 parts |

The preceding were introduced into a stirrer-equipped mixing vessel followed by heating to 90° C. and the execution of a dispersion treatment for 60 minutes by circulation to a Clearmix W-Motion (M Technique Co., Ltd.).

The conditions in the dispersion treatment were as follows.

| | |
|---|---|
| rotor outer diameter | 3 cm |
| clearance | 0.3 mm |
| rotor rotation rate | 19,000 r/min |
| screen rotation rate | 19,000 r/min |

This dispersion treatment was followed by cooling to 40° C. under cooling treatment conditions of a rotor rotation rate of 1,000 r/min, a screen rotation rate of 0 r/min, and a cooling rate of 10° C./min, thereby yielding an aqueous dispersion (the aliphatic hydrocarbon fine particle dispersion) of aliphatic hydrocarbon fine particles at a concentration of 20%. The median diameter on a volume basis of the aliphatic hydrocarbon fine particles, as measured using a dynamic light-scattering particle size distribution analyzer (Nanotrac, Nikkiso Co., Ltd.), was 0.15 μm.

<Silicone Oil Emulsion Production Example>

| | |
|---|---|
| silicone oil (dimethylsilicone oil, Shin-Etsu Chemical Co., Ltd.: KF96-50CS) | 20.0 parts |
| anionic surfactant (DKS Co. Ltd.: Neogen RK) | 1.0 part |
| deionized water | 79.0 parts |

The preceding were mixed and dissolved and dispersion was carried out for approximately 1 hour using a Nanomizer high-pressure impact-type disperser (Yoshida Kikai Co., Ltd.) to prepare an aqueous dispersion (the silicone oil emulsion) containing, in a concentration of 20%, silicone oil provided by the dispersion of silicone oil. The median diameter on a volume basis of the silicone oil particles in the obtained silicone, oil emulsion, as measured using a dynamic light-scattering particle size distribution analyzer (Nanotrac, Nikkiso Co, Ltd.), was 0.09 μm.

<Toner 1 Production Example>

| | |
|---|---|
| resin fine particle A1 dispersion | 375 parts |
| crosslinked resin fine particle B1 dispersion | 125 parts |
| colorant fine particle dispersion | 80 parts |
| aliphatic hydrocarbon fine particle dispersion | 150 parts |
| silicone oil emulsion | 100 parts |
| deionized water | 110 parts |

These materials were all introduced into a round stainless steel flask and were mixed, after which 60 parts of a 10% aqueous solution of magnesium sulfate was added. Dispersion was then carried out for 10 minutes at 5,000 r/min using a homogenizer (IKA: Ultra Turrax T50).

Heating to 73° C. was subsequently carried out on a heating water bath while using an impeller and adjusting the rotation rate as appropriate to stir the mixture.

After holding for 20 minutes at 73° C., it was confirmed that the median diameter on a volume basis of the aggregated particle that had formed was approximately 6.0 μm.

340 parts of a 5% aqueous solution of sodium ethylenediaminetetraacetate was further added to this dispersion containing aggregated particles, and heating to 98° C. was then carried out while continuing to stir. Fusion in the aggregated particles was brought about by holding for 1 hour at 98° C.

Crystallization of the ethylene-vinyl acetate copolymer was thereafter promoted by cooling to 50° C. and holding for 3 hours. This was followed by cooling to 25° C., filtration and solid/liquid separation, then washing the filter cake with a 0.5% aqueous solution of sodium ethylenediaminetetraacetate, and further washing with deionized water.

After the completion of washing, drying was carried out using a vacuum dryer to yield a toner particle 1 having a median diameter on a volume basis of 5.4 μm.

A toner 1 was obtained by dry-mixing the following with 100 parts of the toner particle 1 using a Henschel mixer (Mitsui Mining Co., Ltd.): 1.5 parts of hydrophobically treated silica fine particles that had a number-average primary particle diameter of 10 nm, and 2.5 parts of hydrophobically treated silica fine particles that had a number-average primary particle diameter of 100 nm. The constituent features of the obtained toner 1 are given in Table 1, Table 2, and Table 3.

<Toner 2 Production Example>

A toner 2 was obtained proceeding as in the Toner 1 Production Example, but changing the resin fine particle A1 dispersion to the resin fine particle A2 dispersion and changing the crosslinked resin fine particle B1 dispersion to the crosslinked resin fine particle B2 dispersion. The median diameter on a volume basis of the obtained toner 2 was 5.3 μm.

<Toner 3 Production Example>

A toner 3 was obtained proceeding as in the Toner 2 Production Example, but using 125 parts for the use amount of the resin fine particle A2 dispersion and using 375 parts for the use amount of the crosslinked resin fine particle B2 dispersion. The median diameter on a volume basis of the obtained toner 3 was 5.5 μm.

<Toner 4 Production Example>

A toner 4 was obtained proceeding as in the Toner 2 Production Example, but without using the resin fine particle A2 dispersion and using 500 parts for the amount of use of the crosslinked resin fine particle B2 dispersion. The median diameter on a volume basis of the obtained toner 4 was 5.8 μm.

<Toner 5 Production Example>

A toner 5 was obtained proceeding as in the Toner 2 Production Example, but using 475 parts for the use amount of the resin fine particle A2 dispersion and using 25 parts for the use amount of the crosslinked resin fine particle B2 dispersion. The median diameter on a volume basis of the obtained toner 5 was 5.5 μm.

<Toner 6 Production Example>

A toner 6 was obtained proceeding as in the Toner 2 Production Example, but without using the aliphatic hydrocarbon fine particle dispersion. The median diameter on a volume basis of the obtained toner 6 was 5.2 μm.

<Toner 7 Production Example>

A toner 7 was obtained proceeding as in the Toner 2 Production Example, but without using the aliphatic hydrocarbon fine particle dispersion and without using the silicone oil emulsion. The median diameter on a volume basis of the obtained toner 7 was 5.4 μm.

<Toner 8 Production Example>

A toner 8 was obtained proceeding as in the Toner 2 Production Example, but changing the crosslinked resin fine particle B2 dispersion to the crosslinked resin fine particle B3 dispersion. The median diameter on a volume basis of the obtained toner 8 was 5.3 μm.

<Toner 9 Production Example>

A toner 9 was obtained proceeding as in the Toner 2 Production Example, but changing the crosslinked resin fine particle. B2 dispersion to the crosslinked resin fine particle B4 dispersion. The median diameter on a volume basis of the obtained toner 9 was 5.5 μm.

<Toner 10 Production Example>

A toner 10 was obtained proceeding as in the Toner 2 Production Example, but changing the crosslinked resin fine particle B2 dispersion to the crosslinked resin fine particle B5 dispersion. The median diameter on a volume basis of the obtained toner 10 was 5.3 μm.

<Toner 11 Production Example>

A toner 11 was obtained proceeding as in the Toner 0.1 Production Example, but changing the resin fine particle A1 dispersion to the resin fine particle A3 dispersion and changing the crosslinked resin fine particle B1 dispersion to the crosslinked resin fine particle B6 dispersion. The median diameter on a volume basis of the obtained toner 11 was 7.8 μm.

<Toner 12 Production Example>

A toner 12 was obtained proceeding as in the Toner 1 Production Example, but changing the resin fine particle A1 dispersion to the resin fine particle A4 dispersion and changing the crosslinked resin fine particle B1 dispersion to the crosslinked resin fine particle B7 dispersion. The median diameter on a volume basis of the obtained toner 12 was 5.3 μm <Toner 13 Production Example>

A toner 13 was obtained proceeding as in the Toner 1 Production Example, but changing the resin fine particle A1 dispersion to the resin fine particle A5 dispersion and changing the crosslinked resin fine particle B1 dispersion to the crosslinked resin fine particle B8 dispersion. The median diameter on a volume basis of the obtained toner 13 was 5.3 μm <Toner 14 Production Example>

A toner 14 was obtained proceeding as in the Toner 1 Production Example, but changing the resin fine particle A1 dispersion to the resin fine particle A6 dispersion and changing the crosslinked resin fine particle B1 dispersion to the crosslinked resin fine particle B9 dispersion. The median diameter on a volume basis of the obtained toner 14 was 5.5 μm.

<Toner 15 Production Example>

A toner 15 was obtained proceeding as in the Toner 1 Production Example, but changing the resin fine particle A1 dispersion to the resin fine particle A7 dispersion and changing the crosslinked resin fine particle B1 dispersion to the crosslinked resin fine particle B10 dispersion. The median diameter on a volume basis of the obtained toner 15 was 5.5 μm.

<Toner 16 Production Example>

A toner 16 was obtained proceeding as in the Toner 1 Production Example, but without using the resin fine particle A1 dispersion and changing the crosslinked resin fine particle B1 dispersion to the crosslinked resin fine particle B11 dispersion. The median diameter on a volume basis of the obtained toner 16 was 5.5 μm.

<Toner 17 Production Example>

A toner 17 was obtained proceeding as in the Toner 2 Production Example, but changing the use amount of the resin fine particle A2 dispersion to 487.5 parts and changing the crosslinked resin fine particle B2 dispersion to the crosslinked resin fine particle B12 dispersion and changing its use amount to 12.5 parts. The median diameter on a volume basis of the obtained toner 17 was 5.4 μm.

<Comparative Toner 1 Production Example>

A comparative toner 1 was obtained proceeding as in the Toner 11 Production Example, but without using the crosslinked resin fine particle B6 dispersion. The median diameter on a volume basis of the obtained comparative toner 1 was 7.6 μm.

<Comparative Toner 2 Production Example>

A comparative toner 2 was obtained proceeding as in the Toner 11 Production Example, but changing the crosslinked resin fine particle B6 dispersion to the resin fine particle B6 dispersion (in the Crosslinked Resin Fine Particle B6 Dispersion Production Example, the aqueous dispersion, at a concentration of 20%, of the resin fine particle B6 prior to the crosslinking process). The median diameter on a volume basis of the obtained comparative toner 2 was 7.8 μm.

<Comparative Toner 3 Production Example>

A comparative toner 3 was obtained proceeding as in the Toner 11 Production Example, but changing the crosslinked resin fine particle B6 dispersion to the crosslinked resin fine particle B13 dispersion. The median diameter on a volume basis of the obtained comparative toner 3 was 8.2 μm.

<Comparative Toner 4 Production Example>

A comparative toner 4 was obtained proceeding as in the Toner 1 Production Example, but changing the resin fine particle A1 dispersion to the resin fine particle A8 dispersion and changing the crosslinked resin fine particle B1 dispersion to the crosslinked resin fine particle B14 dispersion. The median diameter on a volume basis of the obtained comparative toner 4 was 6.2 μm.

<Comparative Toner 5 Production Example>

A comparative toner 5 was obtained proceeding as in the Toner 1 Production Example, but changing the resin fine particle A1 dispersion to the resin fine particle A9 dispersion and changing the crosslinked resin fine particle B1 dispersion to the crosslinked resin fine particle B15 dispersion. The median diameter on a volume basis of the obtained comparative toner 5 was 5.5 μm.

<Comparative Toner 6 Production Example>

| | |
|---|---|
| resin fine particle A10 dispersion | 375 parts |
| crosslinked resin fine particle B16 dispersion | 125 parts |
| colorant fine particle dispersion | 80 parts |
| aliphatic hydrocarbon fine particle dispersion | 50 parts |
| deionized water | 310 parts |

These materials were each introduced into a round stainless steel flask and were mixed, after which 60 parts of a 10% aqueous solution of magnesium sulfate was added. Dispersion was then carried out for 10 minutes at 5,000 r/min using a homogenizer (IKA: Ultra Turrax T50).

Heating to 73° C. was subsequently carried out on a heating water bath while using an impeller and adjusting the rotation rate as appropriate to stir the mixture.

After holding for 20 minutes at 73° C., it was confirmed that the median diameter on a volume basis of the aggregated particles that had formed was approximately 6.0 μm.

340 parts of a 5% aqueous solution of sodium ethylenediaminetetraacetate was further added to this dispersion containing aggregated particles, and heating to 98° C. was then carried out while continuing to stir. Fusion in the aggregated particles was brought about by holding for 1 hour at 98° C.

This was followed by cooling to 25° C., filtration and solid/liquid separation, and then washing with deionized water.

After the completion of washing, drying was carried out using a vacuum dryer to yield a comparative toner particle 6 having a median diameter on a volume basis of 5.4 μm.

A comparative toner 6 was obtained by dry-mixing the following with 100 parts of the comparative toner particle 6 using a Henschel mixer (Mitsui Mining Co., Ltd.): 1.5 parts of hydrophobically treated silica fine particles that had a number-average primary particle diameter of 10 nm, ° and 2.5 parts of hydrophobically treated silica fine particles that had a number-average primary particle diameter of 1.00 nm.

<Comparative Toner 7 Production Example>

A comparative toner 7 was obtained proceeding as in the Comparative Toner 6 Production Example, but changing the resin fine particle A10 dispersion to the resin fine particle A11 dispersion and without using the crosslinked resin fine particle B16 dispersion. The median diameter on a volume basis of the obtained comparative toner 7 was 5.4 μm.

Examples 1 to 17 and Comparative Examples 1 to 7

The following evaluation tests were performed using toners 1 to 17 and comparative toners 1 to 7. The results of the evaluations are given in Table 4-1 and Table 4-2.

<Evaluation of Low-Temperature Fixability>

A two-component developer was prepared by mixing the toner at a toner concentration of 8 mass % with a ferrite carrier' (average particle diameter=42 μm) that had a silicone resin coated on its surface.

An unfixed toner image (0.75 mg/cm$^2$) was formed on image-receiving paper (64 g/m$^2$) using a commercial full-color digital copier (CLC1100, Canon Inc.).

The fixing unit was removed from a commercial full-color digital copier (imageRUNNER ADVANCE C5051, Canon Inc.) and was modified to enable the fixation temperature to be adjustable, and this was used to carry out a fixability test on the unfixed toner image.

Operating in an environment at a room temperature of 15° C. and a humidity of 10% RH and with the process speed set to 357 mm/sec, visual evaluation was performed of the state when the unfixed toner image was fixed.

A: fixing could be achieved at a temperature of 140° C. or below

B: fixing could be achieved at a temperature higher than 140° C. and not more than 150° C.

C: fixing could be achieved at a temperature higher than 150° C., or there was no temperature region in which fixing was possible <Evaluation of Hot Offset Resistance>

The two-component developer prepared in "Evaluation of Low-Temperature Fixability" was used.

For the evaluation, an unfixed toner image (0.1 mg/cm$^2$) was formed on image-receiving paper (64 g/m$^2$) using a commercial full-color digital copier (CLC1100, Canon Inc.).

The fixing unit was removed from a commercial full-color digital copier (imageRUNNER ADVANCE C5051, Canon Inc.) and was modified to enable the fixation temperature to be adjustable, and this was used to carry out a fixability test on the unfixed toner image.

Operating in an environment at a room temperature of 23° C. and a humidity of 5% RH and with the process speed set to 357 mm/sec, visual evaluation was performed of the state provided by the fixing of the unfixed toner image. Specifically, the generation of hot offset was scored based on the presence/absence of adhesion to the fixing roller by the toner for which fixing was attempted under the indicated conditions.

A: hot offset was generated at a temperature higher than 160° C., or hot offset was not generated up to 200° C.

B: hot offset was generated at a temperature higher than 140° C. and not more than 160° C.

C: hot offset was generated at a temperature higher than 130° C. and not more than 140° C.

D: hot offset was generated at a temperature of 130° C. or below

<Evaluation of Charge Retention Behavior>

0.01 g of the toner was weighed into an aluminum pan and was charged to −600 V using a scorotron charging device. Then, operating in an environment with a temperature of 30° C. and a humidity of 80% RH, the change in the surface potential was measured for 30 minutes using a surface potential meter (Trek Japan KK, Model 347).

The charge retention ratio was calculated from the measurement results using the following formula. The charge retention behavior was evaluated based on this charge retention ratio.

charge retention ratio (%) after 30 minutes=(surface potential after 30 minutes/initial surface potential)×100

A: the charge retention ratio was at least 90%

B: the charge retention ratio was at least 50% and less than 90%

C: the charge retention ratio was at least 10% and less than 50%

D: the charge retention ratio was less than 10%

<Evaluation of Storability (Blocking Resistance)>

The toner was allowed to stand for 3 days in a constant-temperature, constant-humidity chamber at a temperature of 50° C. and a humidity of 50% RH, and the degree of blocking was then visually evaluated.

A: blocking was not produced, or blocking was produced but was easily dispersed by light shaking B: blocking was produced, but was dispersed when shaking was continued C: blocking was produced and was not dispersed even with the application of force <Evaluation of Eraser Resistance>

The toner was fixed using the same procedure as in the "Evaluation of Low-Temperature Fixability". The resistance to removal using an eraser (product name: MONO, Tombow Pencil Co., Ltd.) was tested on the fixed material obtained at a fixation temperature of 155° C.

A: not removed by the eraser

B: the image density was lowered by removal with the eraser

C: removal by the eraser occurred

<Evaluation of Gloss>

The toner was fixed by the same procedure as in the method for evaluating the low-temperature fixability. The 60° gloss was measured at a fixation temperature of 140° C. using a gloss meter (product name: VG7000, manufacturer: Nippon Denshoku Industries Co., Ltd.).

A: gloss of at least 10
B: gloss of at least 5 and less than 10
C: gloss of less than 5, or fixing could not be performed at 140° C.

TABLE 1

| olefin copolymer having ester group | monomer unit Y2 content (mass %) | (l + m + n)/W | melting point (° C.) | softening point [Tm] (° C.) | elongation at break (%) |
|---|---|---|---|---|---|
| EVA-A | 15 | 1.00 | 86 | 128 | 700% |
| EVA-B | 15 | 1.00 | 77 | 83 | — |

TABLE 1-continued

| olefin copolymer having ester group | monomer unit Y2 content (mass %) | (l + m + n)/W | melting point (° C.) | softening point [Tm] (° C.) | elongation at break (%) |
|---|---|---|---|---|---|
| EVA-C | 15 | 0.96 | 75 | 130 | 600% |
| EVA-D | 5 | 0.75 | 71 | 118 | 550% |
| EVA-E | 2 | 1.00 | 105 | 156 | 600% |
| EVA-F | 41 | 1.00 | 40 | 160 | 870% |
| EEA-A | 15 | 1.00 | 87 | 125 | 800% |

TABLE 2

| aliphatic hydrocarbon resin having unsaturated bond | structure | weight-average molecular weight (Mw) | melting point (° C.) | content of 1,2-polybutadiene structure (mass %) | syndiotactic structure ratio (mass %) |
|---|---|---|---|---|---|
| Al-A | polybutadiene | 205000 | 70 | 90 | 50 |
| Al-B | polybutadiene | 210000 | 95 | 92 | 55 |
| Al-C | polybutadiene | 3000 | — | 90 | 20 |
| Al-D | 1,4-poly(1-propylbuta-1,3-diene) | 120000 | 40 | — | — |

TABLE 3

| | resin fine particle A dispersion | | | | crosslinked resin fine particle B dispersion | | | | | | | |
|---|---|---|---|---|---|---|---|---|---|---|---|---|
| | | | | | | aliphatic | | | | | | |
| toner No. | resin fine particle | olefin copolymer having ester group | olefin copolymer having acid group | other resin | crosslinked resin fine particle | olefin copolymer having ester group | hydrocarbon resin having unsaturated bond | olefin copolymer having acid group | other resin | X | Y | Z |
| 1 | A1 | EVA-A | EMA-A | — | B1 | EVA-A | Al-A | EMA-A | — | 2.0 | 30 | 20 |
| 2 | A2 | EVA-A<br>EVA-B | EMA-A | — | B2 | EVA-A<br>EVA-B | Al-A | EMA-A | — | 2.0 | 30 | 20 |
| 3 | A2 | EVA-A<br>EVA-B | EMA-A | — | B2 | EVA-A<br>EVA-B | Al-A | EMA-A | — | 6.0 | 30 | 20 |
| 4 | — | — | — | — | B2 | EVA-A<br>EVA-B | Al-A | EMA-A | — | 8.0 | 30 | 20 |
| 5 | A2 | EVA-A<br>EVA-B | EMA-A | — | B2 | EVA-A<br>EVA-B | Al-A | EMA-A | — | 0.4 | 30 | 20 |
| 6 | A2 | EVA-A<br>EVA-B | EMA-A | — | B2 | EVA-A<br>EVA-B | Al-A | EMA-A | — | 2.0 | 0 | 20 |
| 7 | A2 | EVA-A<br>EVA-B | EMA-A | — | B2 | EVA-A<br>EVA-B | Al-A | EMA-A | — | 2.0 | 0 | 0 |
| 8 | A2 | EVA-A<br>EVA-B | EMA-A | — | B3 | EVA-A<br>EVA-B | Al-B | EMA-A | — | 2.0 | 30 | 20 |
| 9 | A2 | EVA-A<br>EVA-B | EMA-A | — | B4 | EVA-A<br>EVA-B | Al-C | EMA-A | — | 2.0 | 30 | 20 |
| 10 | A2 | EVA-A<br>EVA-B | EMA-A | — | B5 | EVA-A<br>EVA-B | Al-D | EMA-A | — | 2.0 | 30 | 20 |
| 11 | A3 | EVA-A<br>EVA-B | — | — | B6 | EVA-A<br>EVA-B | Al-A | — | — | 2.0 | 30 | 20 |
| 12 | A4 | EEA-A | EMA-A | — | B7 | EEA-A | Al-A | EMA-A | — | 2.0 | 30 | 20 |
| 13 | A5 | EVA-A | EMA-A | PES-A | B8 | EVA-A<br>PES-A | Al-A | EMA-A | — | 2.0 | 30 | 20 |
| 14 | A6 | EVA-C | EMA-A | — | B9 | EVA-C | Al-A | EMA-A | — | 2.0 | 30 | 20 |
| 15 | A7 | EVA-D | EMA-A | — | B10 | EVA-D | Al-A | EMA-A | — | 2.0 | 30 | 20 |
| 16 | — | — | — | — | B11 | EVA-A<br>EVA-B | Al-A | EMA-A | — | 2.0 | 30 | 20 |
| 17 | A2 | EVA-A<br>EVA-B | EMA-A | — | B12 | — | Al-A | EMA-A | — | 2.0 | 30 | 20 |
| Comparative 1 | A3 | EVA-A<br>EVA-B | — | — | — | — | — | — | — | — | 30 | 20 |
| Comparative 2 | A3 | EVA-A<br>EVA-B | — | — | uncross-linked B6 | EVA-A<br>EVA-B | Al-A | — | — | uncross-linked 2.0 | 30 | 20 |
| Comparative 3 | A3 | EVA-A<br>EVA-B | — | — | B13 | EVA-A<br>EVA-B | PES-B | — | — | PES cross-linked 2.0 | 30 | 20 |

TABLE 3-continued

| | resin fine particle A dispersion | | | | crosslinked resin fine particle B dispersion | | | | | | | |
|---|---|---|---|---|---|---|---|---|---|---|---|---|
| | | | | | | aliphatic | | | | | | |
| toner No. | resin fine particle | olefin copolymer having ester group | olefin copolymer having acid group | other resin | crosslinked resin fine particle | olefin copolymer having ester group | hydrocarbon resin having unsaturated bond | olefin copolymer having acid group | other resin | X | Y | Z |
| Comparative 4 | A8 | EVA-E | EMA-A | — | B14 | EVA-E | Al-A | EMA-A | — | 2.0 | 30 | 20 |
| Comparative 5 | A9 | EVA-F | EMA-A | — | B15 | EVA-F | Al-A | EMA-A | — | 2.0 | 30 | 20 |
| Comparative 6 | A10 | — | — | PES-A | B16 | — | Al-A | — | PES-A | 2.0 | 10 | 0 |
| Comparative 7 | A11 | — | — | CPES-A | — | — | — | — | — | — | 10 | 0 |

In the table, X refers to the "content (mass %) in the resin component of the crosslinked body from the aliphatic hydrocarbon resin having unsaturated bond"; Y refers to the "number of parts by mass of the aliphatic hydrocarbon with respect to 100 parts by mass of the resin component"; and'Z refers to the "number of parts by mass of the silicone oil with respect to 100 parts by mass of the resin component".

TABLE 4-1

| Example | toner No. | low-temperature fixability | hot offset resistance | charge retention behavior |
|---|---|---|---|---|
| Example 1 | 1 | A | A | A |
| Example 2 | 2 | A | B | A |
| Example 3 | 3 | A | A | A |
| Example 4 | 4 | B | A | A |
| Example 5 | 5 | A | C | A |
| Example 6 | 6 | B | A | A |
| Example 7 | 7 | B | C | A |
| Example 8 | 8 | A | B | A |
| Example 9 | 9 | A | C | B |
| Example 10 | 10 | A | C | B |
| Example 11 | 11 | B | B | A |
| Example 12 | 12 | B | A | A |
| Example 13 | 13 | B | A | A |
| Example 14 | 14 | A | A | B |
| Example 15 | 15 | A | B | C |
| Example 16 | 16 | A | B | A |
| Example 17 | 17 | A | C | A |
| Comparative Example 1 | Comparative 1 | B | D | A |
| Comparative Example 2 | Comparative 2 | B | D | A |
| Comparative Example 3 | Comparative 3 | B | D | A |
| Comparative Example 4 | Comparative 4 | C | A | A |
| Comparative Example 5 | Comparative 5 | A | A | D |
| Comparative Example 6 | Comparative 6 | C | A | A |
| Comparative Example 7 | Comparative 7 | A | D | D |

TABLE 4-2

| Example | toner No. | blocking resistance | eraser resistance | gloss |
|---|---|---|---|---|
| Example 1 | 1 | A | A | C |
| Example 2 | 2 | B | A | A |
| Example 3 | 3 | B | A | C |
| Example 4 | 4 | B | A | C |
| Example 5 | 5 | A | A | A |

TABLE 4-2-continued

| Example | toner No. | blocking resistance | eraser resistance | gloss |
|---|---|---|---|---|
| Example 6 | 6 | A | B | C |
| Example 7 | 7 | A | B | C |
| Example 8 | 8 | A | A | B |
| Example 9 | 9 | C | A | A |
| Example 10 | 10 | C | A | B |
| Example 11 | 11 | C | C | A |
| Example 12 | 12 | A | A | C |
| Example 13 | 13 | B | A | C |
| Example 14 | 14 | B | A | C |
| Example 15 | 15 | C | A | C |
| Example 16 | 16 | B | A | B |
| Example 17 | 17 | B | A | A |

The present invention can thus provide a toner that exhibits an excellent low-temperature fixability, charge retention behavior, and hot offset resistance, can also provide a method for producing this toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-173460, filed, Sep. 6, 2016, and Japanese Patent Application No. 2017-151357, filed, Aug. 4, 2017, which are hereby incorporated by reference herein in their entirety.

What is claimed is:

1. A toner comprising a toner particle containing a resin component, wherein the resin component contains an olefin copolymer having ester group and a crosslinked body from an aliphatic hydrocarbon resin having unsaturated bond, the olefin copolymer having ester group has:

a monomer unit Y1 represented by the following formula (1); and a monomer unit Y2 that is at least one selected from the group consisting of monomer units represented by the following formula (2) and monomer units represented by the following formula (3), a content of the olefin copolymer having ester group in the resin component is at least 50 mass % with respect to the total mass of the resin component, and a content of the monomer unit Y2 is at least 3 mass % and not more than 35 mass % with respect to the total mass of the olefin copolymer having ester group (1)

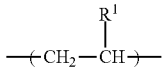

(2)

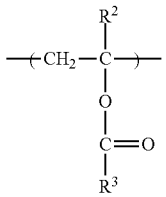

(3)

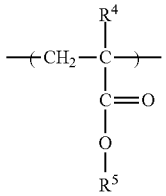

in formulas (1) to (3), $R^1$ represents H or $CH_3$, $R^2$ represents H or $CH_3$, $R^3$ represents $CH_3$ or $C_2H_5$, $R^4$ represents H or $CH_3$, and $R^5$ represents $CH_3$ or $C_2H_5$.

2. The toner according to claim 1, wherein the value of (l+m+n)/W for the olefin copolymer having ester group in the resin component is at least 0.80, where W is the total mass of the olefin copolymer having ester group, l is the mass of monomer units represented by formula (1), m is the mass of monomer units represented by formula (2), and n is the mass of monomer units represented by formula (3).

3. The toner according to claim 1, wherein a content of the crosslinked body from the aliphatic hydrocarbon resin having unsaturated bond is at least'1.0 mass % and not more than 8.0 mass % with respect to the total mass of the resin component.

4. The toner according to claim 1, wherein the aliphatic hydrocarbon resin having unsaturated bond is polybutadiene.

5. The toner according to claim 4, wherein a weight-average molecular weight of the polybutadiene is at least 10,000 and not more than 300,000.

6. The toner according to claim 4, wherein the polybutadiene has a 1,2-polybutadiene structure, a content of the 1,2polybutadiene structure in the polybutadiene is at least 70 mass %, and at least 50 mass % of the 1,2-polybutadiene structure is a syndiotactic structure.

7. The toner according to claim 4, wherein a melting point of the polybutadiene is at least 60° C. and not more than 80° C.

8. The toner according to claim 1, wherein the resin component further contains at least one of an ethylene-methacrylic acid copolymer and an ethylene-acrylic acid copolymer.

9. The toner according to claim 1, wherein the olefin copolymer having ester group contains an olefin copolymer A having ester group having a softening point of at least 120° C. and not more than 160° C., and an olefin copolymer B having ester group having a softening point of at least 70° C. and not more than 100° C.

10. The toner according to claim 1, wherein the toner particle contains an aliphatic hydrocarbon having a melting point of at least 50° C. and not more than 100° C., and a content of the aliphatic hydrocarbon is at least 1 part by mass and not more than 40 parts by mass with respect to 100 parts by mass of the resin component.

11. The toner according to claim 1, wherein the toner particle contains a silicone oil, and a content of the silicone oil is at least 1 part by mass and not more than 20 parts by mass with respect to 100 parts by mass of the resin component.

12. The toner according to claim 1, wherein the olefin copolymer having ester group is an ethylene-vinyl acetate copolymer.

13. A method for producing a toner having a toner particle containing a resin component, the resin component containing an olefin copolymer having ester group and a crosslinked, body from an aliphatic hydrocarbon resin having unsaturated bond, the method comprising:

a preparation step of preparing a resin fine particle dispersion in which resin fine particles that form the resin component are dispersed in an aqueous medium; and a crosslinking step of crosslinking, using a crosslinking agent, the aliphatic hydrocarbon resin having unsaturated bond present in the resin fine particles, wherein the olefin copolymer having ester group has:

a monomer unit Y1 represented by the following formula (1); and a monomer unit Y2 that is at least one selected from the group consisting of monomer units represented by the following formula (2) and monomer units represented by the following formula (3), a content of the olefin copolymer having ester group in the resin component is at least 50 mass % with respect to the total mass of the resin component, and a content of the monomer unit Y2 is at least 3 mass % and not more than 35 mass % with respect to the total mass of the olefin copolymer having ester group (1)

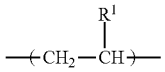

(2)

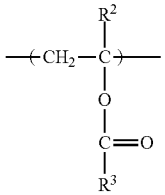

(3)

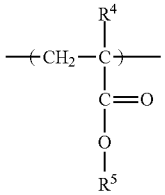

in formulas (1) to (3), $R^1$ represents H or $CH_3$, $R^2$ represents H or $CH_3$, $R^3$ represents $CH_3$ or $C_2H_5$, $R^4$ represents H or $CH_3$, and $R^5$ represents $CH_3$ or $C_2H_5$.

14. The method for producing the toner according to claim 13, further comprising, after the preparation step of preparing a resin fine particle dispersion:

an aggregation step of aggregating the resin fine particles to form an aggregated particle; and a fusion step of fusing the aggregated particle by heating, wherein the crosslinking step is a step of crosslinking, using the crosslinking agent, the aliphatic hydrocarbon resin having unsaturated bond present in the resin fine particles, the crosslinking step being provided between the preparation step of preparing a resin fine particle dispersion and the aggregation step.

15. The method for producing the toner according to claim 14, wherein the resin fine particles include a resin fine particle A and a resin fine particle B, the resin fine particle A contains an olefin copolymer having ester group and does not contain an aliphatic hydrocarbon resin having unsaturated bond, the resin fine particle B contains an olefin copolymer having ester group and an aliphatic hydrocarbon resin having unsaturated bond, and a median diameter on a volume basis of the resin fine particle B is at least 50 nm and not more than 1,000 nm, the crosslinking step is a step of crosslinking, using the crosslinking agent, the aliphatic hydrocarbon resin having unsaturated bond present in the resin fine particle B, the crosslinking step being provided after completion of the preparation step of preparing a resin fine particle dispersion and prior to start of the aggregation step, and the aggregation step is a step of forming an aggregated particle by aggregating the resin fine particle A with the resin fine particle B that has been subjected to the crosslinking step.

16. The method for producing the toner according to claim 14, wherein a content of the aliphatic hydrocarbon resin having unsaturated bond in the resin fine particle B is at least 5 mass % and not more than 20 mass % with respect to the total amount of resin constituting the resin fine particle B.

17. The method for producing the toner according to claim 13, wherein the olefin copolymer having ester group is an ethylene-vinyl acetate copolymer, and the aliphatic hydrocarbon resin having unsaturated bond is polybutadiene.

* * * * *